US008186006B2

(12) United States Patent
Hyun et al.

(10) Patent No.: US 8,186,006 B2
(45) Date of Patent: May 29, 2012

(54) DUST SEPARATION APPARATUS OF VACUUM CLEANER

(75) Inventors: Kie-Tak Hyun, Changwon (KR); Hae-Seock Yang, Changwon (KR); Kyeong-Seon Jeong, Changwon (KR); Chang-Hoon Lee, Changwon (KR); Seong-Koo Cho, Changwon (KR); Geun-Bae Hwang, Changwon (KR); Jin-Wook Seo, Changwon (KR); Heon-Pyeong Ji, Changwon (KR); Man-Tae Hwang, Changwon (KR); Young-Ho Kim, Changwon (KR); Hyo-Churl Shin, Changwon (KR); Jin-Hyouk Shin, Changwon (KR); Hoi-Kil Jeong, Changwon (KR); Moo-Hyun Ko, Changwon (KR)

(73) Assignee: LG Electronics Inc., Seoul (KR)

( * ) Notice: Subject to any disclaimer, the term of this patent is extended or adjusted under 35 U.S.C. 154(b) by 371 days.

(21) Appl. No.: 12/404,105

(22) Filed: Mar. 13, 2009

(65) Prior Publication Data

US 2009/0172913 A1 Jul. 9, 2009

Related U.S. Application Data

(63) Continuation of application No. PCT/KR2008/003324, filed on Jun. 13, 2008.

(30) Foreign Application Priority Data

Jul. 19, 2007 (KR) ..... 10-2007-0072265
Jul. 19, 2007 (KR) ..... 10-2007-0072267
Jul. 19, 2007 (KR) ..... 10-2007-0072270
Oct. 25, 2007 (KR) ..... 10-2007-0107700
Nov. 15, 2007 (KR) ..... 10-2007-0116452

(51) Int. Cl.
*A47L 9/10* (2006.01)

(52) U.S. Cl. ..... 15/347; 15/348; 15/352

(58) Field of Classification Search ..... 15/347, 15/348, 352
See application file for complete search history.

(56) References Cited

U.S. PATENT DOCUMENTS

| | | | | |
|---|---|---|---|---|
| 447,333 | A * | 3/1891 | Kutsche | 55/349 |
| 3,505,703 | A | 4/1970 | Miller et al. | |
| 6,332,239 | B1 | 12/2001 | Dubos et al. | |
| 6,350,292 | B1 | 2/2002 | Lee et al. | |
| 6,436,160 | B1 | 8/2002 | Stephens et al. | |
| 6,572,668 | B1 * | 6/2003 | An et al. | 55/428 |
| 6,613,129 | B2 | 9/2003 | Gen | |

(Continued)

FOREIGN PATENT DOCUMENTS

DE 10 2004 030 350 A1 1/2006

(Continued)

*Primary Examiner* — Lee D Wilson
*Assistant Examiner* — Shantese McDonald
(74) *Attorney, Agent, or Firm* — Birch, Stewart, Kolasch & Birch, LLP

(57) ABSTRACT

A distribution unit for a dust separating apparatus of a vacuum cleaner is provided. The distribution unit distributes air and dust to the dust separation unit includes a body having an inlet for introducing the air and dust to the body, a plurality of branch passages for distributing the air introduced into the body to the dust separation unit, and a main passage for connecting the inlet with the branch passages, and wherein a passage cross-sectional area of the main passage at the branch passage is greater than a passage cross-sectional area of the inlet.

25 Claims, 26 Drawing Sheets

U.S. PATENT DOCUMENTS

| | | | | |
|---|---|---|---|---|
| 6,679,930 | B1 | 1/2004 | An et al. | |
| 6,810,558 | B2 | 11/2004 | Lee | |
| 7,419,521 | B2 | 9/2008 | Oh et al. | |
| 7,488,362 | B2 | 2/2009 | Jeong et al. | |
| 7,534,279 | B2 * | 5/2009 | Oh et al. | 55/343 |
| 7,628,833 | B2 | 12/2009 | Oh | |
| 7,686,861 | B2 | 3/2010 | Oh | |
| 2005/0229554 | A1 | 10/2005 | Oh et al. | |
| 2005/0252179 | A1 | 11/2005 | Oh et al. | |
| 2006/0075728 | A1 | 4/2006 | Oh et al. | |
| 2006/0107630 | A1 | 5/2006 | Ivarsson et al. | |
| 2006/0117725 | A1 | 6/2006 | Oh et al. | |
| 2007/0011997 | A1 | 1/2007 | Han et al. | |
| 2007/0079585 | A1 | 4/2007 | Oh et al. | |
| 2009/0056290 | A1 | 3/2009 | Oh et al. | |
| 2009/0293224 | A1 | 12/2009 | Hyun et al. | |
| 2010/0043170 | A1 | 2/2010 | Ni | |

FOREIGN PATENT DOCUMENTS

| | | | |
|---|---|---|---|
| DE | 20 2006 016 366 | U1 | 3/2007 |
| EP | 0996355 | B1 | 8/2004 |
| GB | 2 417 916 | A | 3/2006 |
| JP | 52-138367 | | 11/1977 |
| JP | 2003-139094 | A | 5/2003 |
| JP | 2004-135700 | A | 5/2004 |
| JP | 2004-174206 | A | 6/2004 |
| JP | 2005-040257 | A | 2/2005 |
| JP | 2005-324002 | A | 11/2005 |
| JP | 2005-342334 | A | 12/2005 |
| JP | 2006-130119 | A | 5/2006 |
| KR | 2000-0056656 | A | 9/2000 |
| KR | 2002-0078798 | A | 10/2002 |
| KR | 20020078798 | * | 10/2002 |
| KR | 10-2005-0100913 | A | 10/2005 |
| KR | 10-2006-0030255 | A | 4/2006 |
| KR | 10-2006-0061493 | A | 6/2006 |
| KR | 10-0623916 | B1 | 9/2006 |
| KR | 10-2006-0105390 | A | 10/2006 |
| RU | 2240716 | C2 | 2/2000 |
| RU | 2281683 | C2 | 8/2006 |
| RU | 2286079 | C2 | 10/2006 |
| RU | 2288628 | C1 | 12/2006 |

* cited by examiner

DUST SEPARATION APPARATUS OF VACUUM CLEANER

CROSS-REFERENCE TO RELATED APPLICATIONS

This application is a continuation of International Patent Application No. PCT/KR2008/003324, filed Jun. 13, 2008, which claims priority to the following Korean Patent Applications, Korean Patent Application No. 10-2007-0072265, filed Jul. 19, 2007, Korean Patent Application No. 10-2007-0072267, filed Jul. 19, 2007, Korean Patent Application No. 10-2007-0072270, filed Jul. 19, 2007, Korean Patent Application No. 10-2007-0107700, filed Oct. 25, 2007, and Korean Patent Application No. 10-2007-0116452, filed Nov. 15, 2007, all of which are herein incorporated by reference in their entireties.

BACKGROUND OF THE INVENTION

1. Field of the Invention

The present invention is directed generally to a distribution unit for distributing dust and air to a dust separation apparatus of a vacuum cleaner, and, more particularly, to a distribution unit having a body including an inlet and at least two passages spaced from the inlet.

2. Description of Related Art

Generally, a vacuum cleaner is an apparatus that sucks air containing dusts using vacuum pressure generated by a suction motor mounted in a main body and filters off the dusts in the main body.

According to this related art vacuum cleaner, air sucked from a suction nozzle should freely flow into a cleaner main body. As such, the air flow is an important criterion in the performance of the vacuum cleaner.

BRIEF SUMMARY OF THE INVENTION

An object of the present invention is to provide distribution unit for a dust separation apparatus of a vacuum cleaner and a dust separation apparatus that improve the dust separation performance of a vacuum cleaner.

Another object of the present invention is to provide a distribution unit for a dust separation apparatus of a vacuum cleaner and a dust separation apparatus that allow air to freely flow into a dust separation unit for separating dusts.

To achieve the objects of the present invention, as embodied and broadly described herein, there is provided a distribution unit to direct air and dust to a dust separation unit of a vacuum cleaner, the distribution unit including a body having an inlet configured to introduce the air and dust to the body, a plurality of branch passages for dividing the air and dust introduced into the body, and a main passage portion connecting the inlet to each of the branch passages. In addition, a cross-sectional area of the main passage portion at the plurality of branch passages is greater than a cross-sectional area of the inlet.

In another aspect of the present invention, there is provided a distribution unit to direct air and dust to a dust separation unit of a vacuum cleaner, the distribution unit including a body having an inlet configured to introduce the air and dust to the body, a first passage having a first portion in communication with the inlet and a first outlet spaced from the inlet, and a second passage having a second portion in communication with the inlet and a second outlet spaced from the inlet. In addition, a volume of the first passage is greater than a volume of the second passage In yet another aspect of the present invention, there is provided a distribution unit to direct air and dust to a dust separation unit of a vacuum cleaner, the distribution unit including a body having an inlet configured to introduce the air and dust to the body, a first passage having a first portion in communication with the inlet and a first outlet spaced from the inlet, and a second passage having a second portion in communication with the inlet and a second outlet spaced from the inlet. In addition, the body is formed to have a laterally asymmetric shape In still another aspect of the present invention, there is provided a dust separation apparatus of a vacuum cleaner, the dust separation apparatus includes a distribution unit and a dust separation unit. The distribution unit can be according to any of the distribution units described above.

In yet a further aspect of the present invention, there is provided a vacuum cleaner having a dust separation apparatus, which includes a distribution unit and a dust separation unit. The distribution unit can be according to any of the distribution units described above.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DETAILED DESCRIPTION OF THE INVENTION

Hereinafter, exemplary embodiments will be explained with reference to the accompanying drawings.

Figure 1:
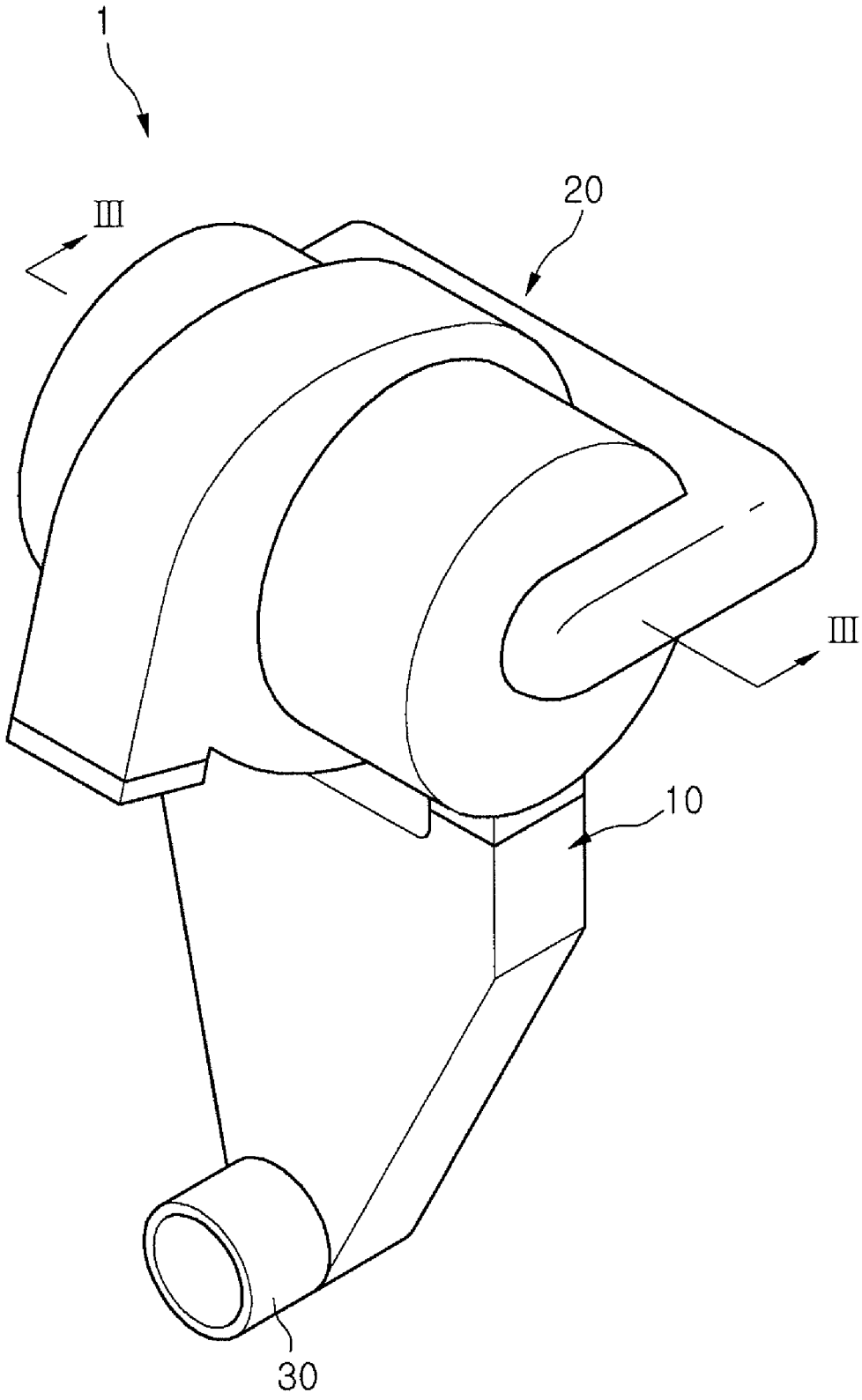
FIG. 1 is a perspective view of a dust separation apparatus of a vacuum cleaner according to a first exemplary embodiment.
Figure 2:
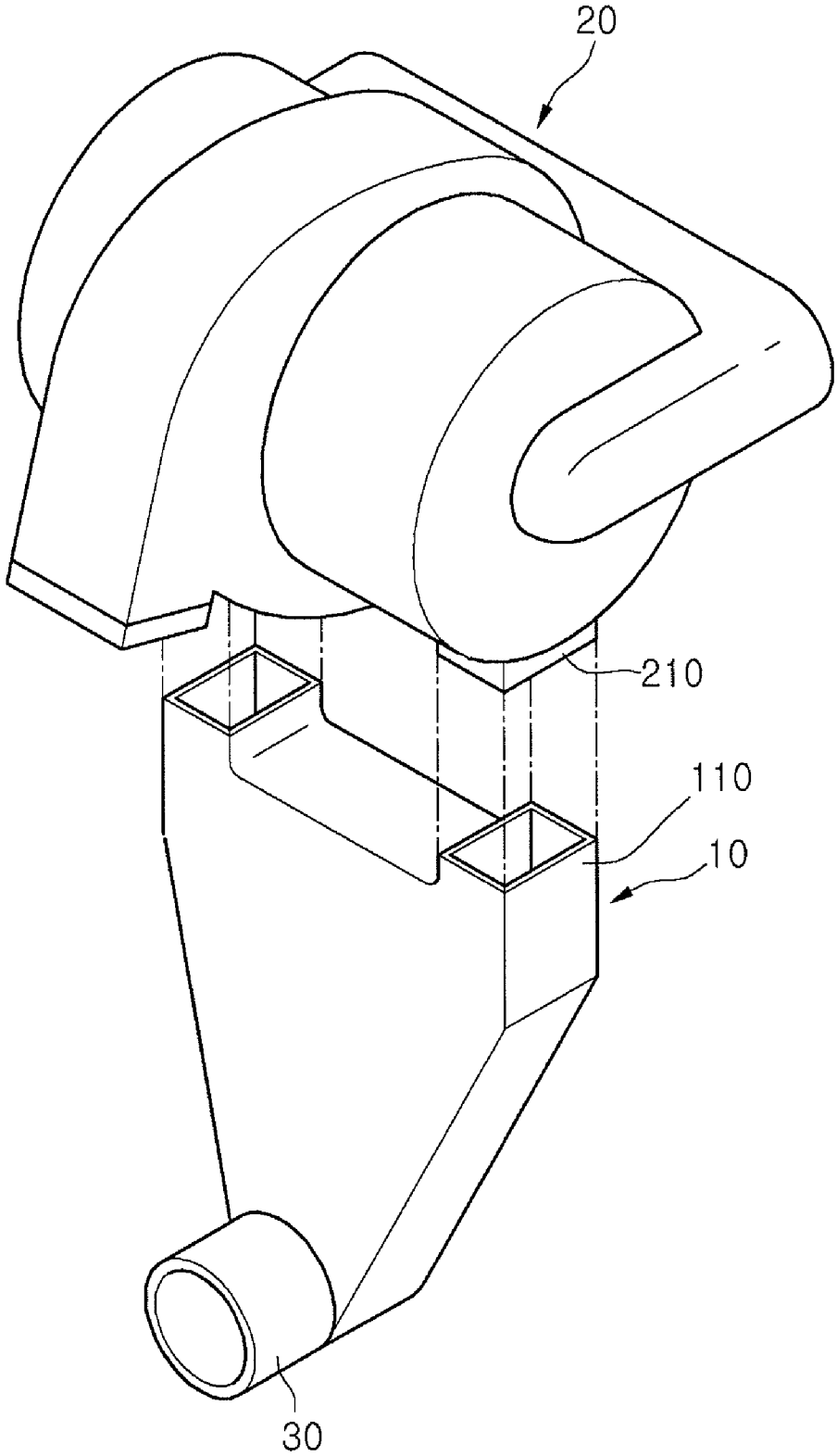
FIG. 2 is an exploded perspective view of the dust separation apparatus of FIG. 1.

Referring to FIGS. 1 and 2, a dust separation apparatus 1 of a vacuum cleaner according to a first exemplary embodiment includes a dust separation unit 20 that separates dust from air, a distribution unit 10 that allows air to be distributed to the dust separation unit 20, and a suction guide 30 that allows air to be moved into the distribution unit 10.

The suction guide 30 is a part that guides air sucked from a suction nozzle (not shown) to the distribution unit 10, and it may be provided as part of a vacuum cleaner main body (not shown). The dust separation unit 20 separates dust from air introduced from the distribution unit 10 and may include a plurality of air-suction parts 210 formed in the dust separation unit 20. The distribution unit 10 is disposed between the suction guide 30 and the dust separation unit 20, and the distribution unit 10 distributes air introduced from the suction guide 30 to each of the air-suction parts 210. The suction guide 30 and the distribution unit 10 may be integrally formed or connected to each other. When the suction guide 30 and the distribution unit 10 are connected to each other, an inlet (not shown) for receiving air and dust from the suction guide 30 is formed at the distribution unit 10. However, when the suction guide 30 and the distribution unit 10 are integrally formed, an inlet of the suction guide 30 serves as the inlet for the distribution unit 10.

In addition, as seen in FIG. 2, the distribution unit 10 includes a plurality of distributing pipes 110 for distributing air. In this exemplary embodiment, each of the distributing pipes 110 is in communication with a corresponding air-suction part 210.

Figure 3:
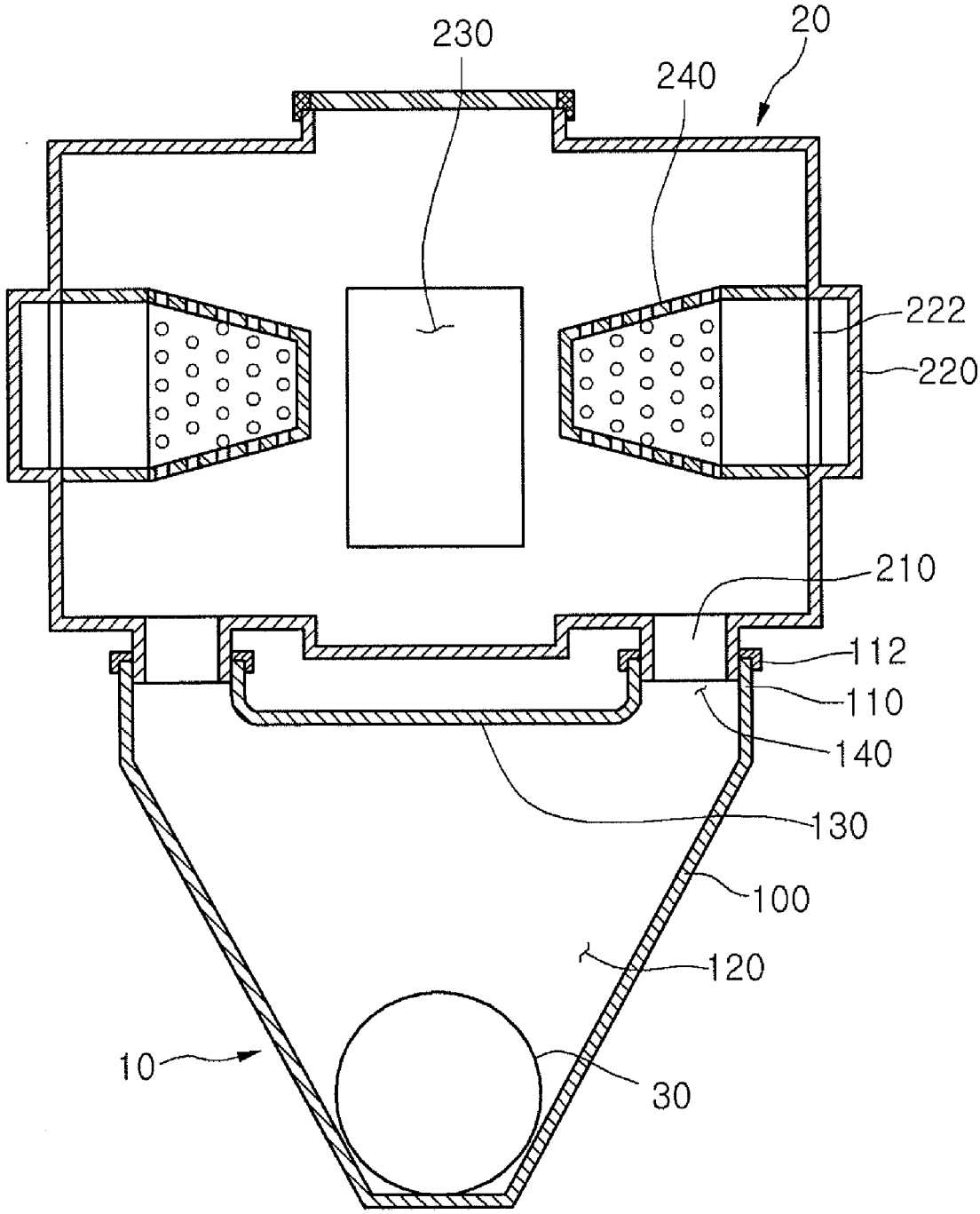
FIG. 3 is a cross-sectional view taken along line III-III of FIG. 1.
Figure 4:
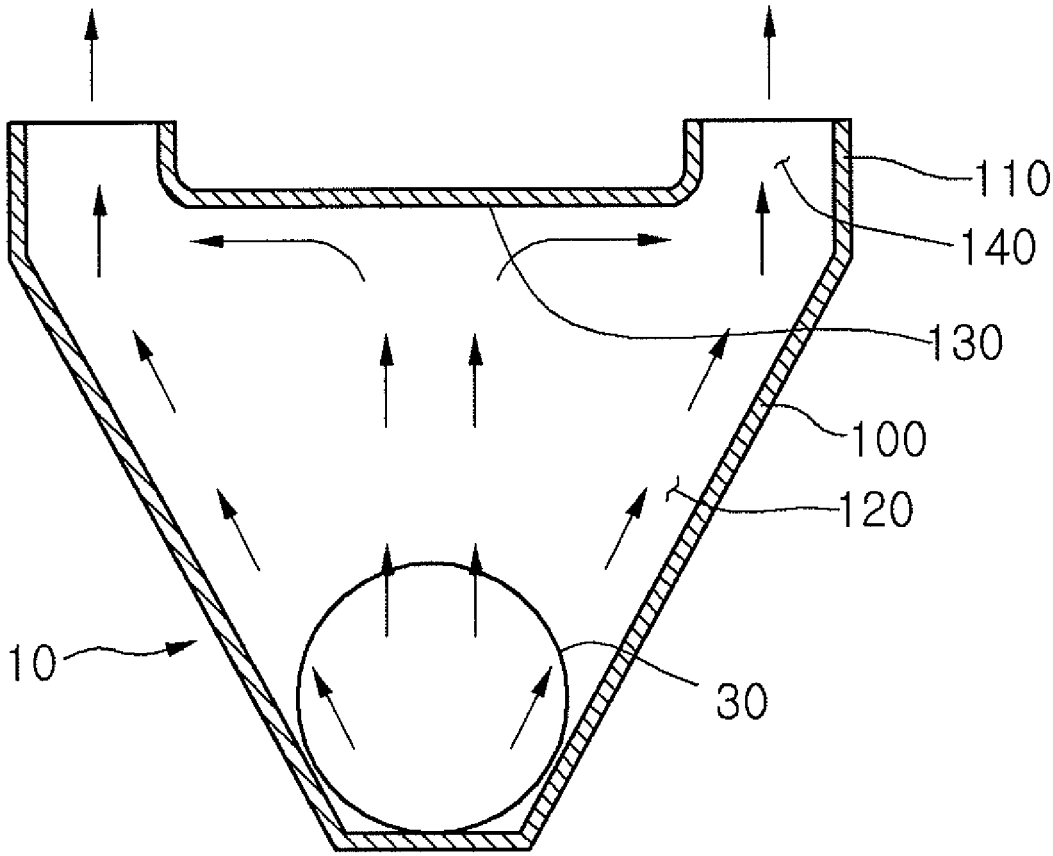
FIG. 4 is a cross-sectional view showing air flow in a distribution unit according to the first exemplary embodiment.

Referring to FIGS. 3 and 4, the distribution unit 10 is disposed below the dust separation unit 20. The distribution unit 10 includes a body 100 having a main passage 120, the plurality of distributing pipes 110 extending from the body 100, and a distribution guide 130 formed between the distributing pipes 110 to guide air to each of the distributing pipes 110. The distribution guide 130 separates the distributing pipes 110 from each other so that they are spaced apart. In this exemplary embodiment, the body 100 is laterally symmetrically formed so that air is uniformly distributed to each of the distributing pipes 110.

In this exemplary embodiment, the respective distributing pipe 110 is connected to an exterior of the respective air-suction part 210. That is, each of the air-suction parts 210 is inserted into corresponding distributing pipes 110. Alternatively, the respective distributing pipe 110 may be inserted into the respective air-suction part 210. In addition, a sealing element 112 for preventing the leakage of air may be provided at a connection region between the air-suction part 210 and the distributing pipe 110.

A branch passage 140 is respectively formed at each of the distributing pipes 110, and the branch passage 140 is in communication with the main passage 120. A passage cross-sectional area of the main passage 120 increases from the suction guide 30 to the branch passages 140 of the distributing pipes 110 so that air introduced into the main passage 120 can be freely distributed to each of the distributing pipes 110.

Having described the features of the first exemplary embodiment, the operation of the dust separation apparatus will be explained. Air containing dust, which is sucked from the outside, is introduced into the main passage 120 of the distribution unit 10 via the suction guide 30. Next, the air introduced into the main passage 120 is moved upwardly toward the distributing pipes 110. During this movement, some of the air is directly moved into the respective distributing pipe 110 and some of the air is moved into respective distributing pipe 110 as it is guided by the distribution guide 130.

The air distributed into the respective distributing pipe 110 is introduced into the dust separation unit 20 via the respective air-suction part 210. The air introduced into the dust separation unit 20 is circulated along an inner circumferential surface of the dust separation unit 20, and in this process, air and dust are separated from each other as different centrifugal forces are applied due to the difference in weight. That is, the dust separation unit 20 separates dust from air containing dust using a cyclone principle.

The separated dust is then discharged from the dust separation unit 20 through a dust discharging part 230 formed at the center of the dust separation unit 20. And, the dust discharged from the dust separation unit 20 is collected in a dust collecting container (not shown). In this exemplary embodiment, the dust discharging part 230 is disposed between the air-suction parts 210.

At the same time that the separated dust is discharged, the air separated from the dust is filtered off as it passes through filter elements 240 installed at both sides of the dust separation unit 20, and then the air passes through air discharging holes 222 formed at both sides of the dust separation unit 20. Finally, the air passed through the air discharging holes 222 is discharged from the dust separation unit 20 as it flows along an air discharging part 220 formed at both outer sides of the dust separation unit 20.

Figure 5:
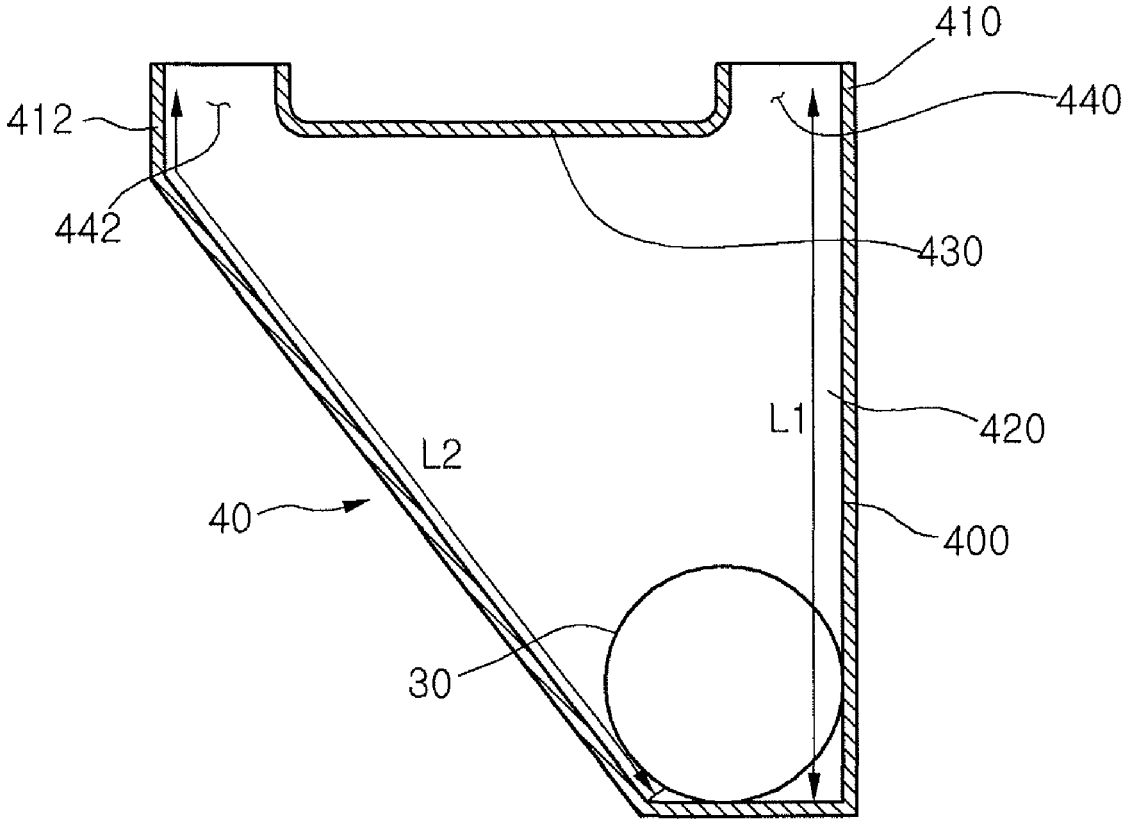
FIG. 5 is a cross-sectional view of a distribution unit according to a second exemplary embodiment.
Figure 6:
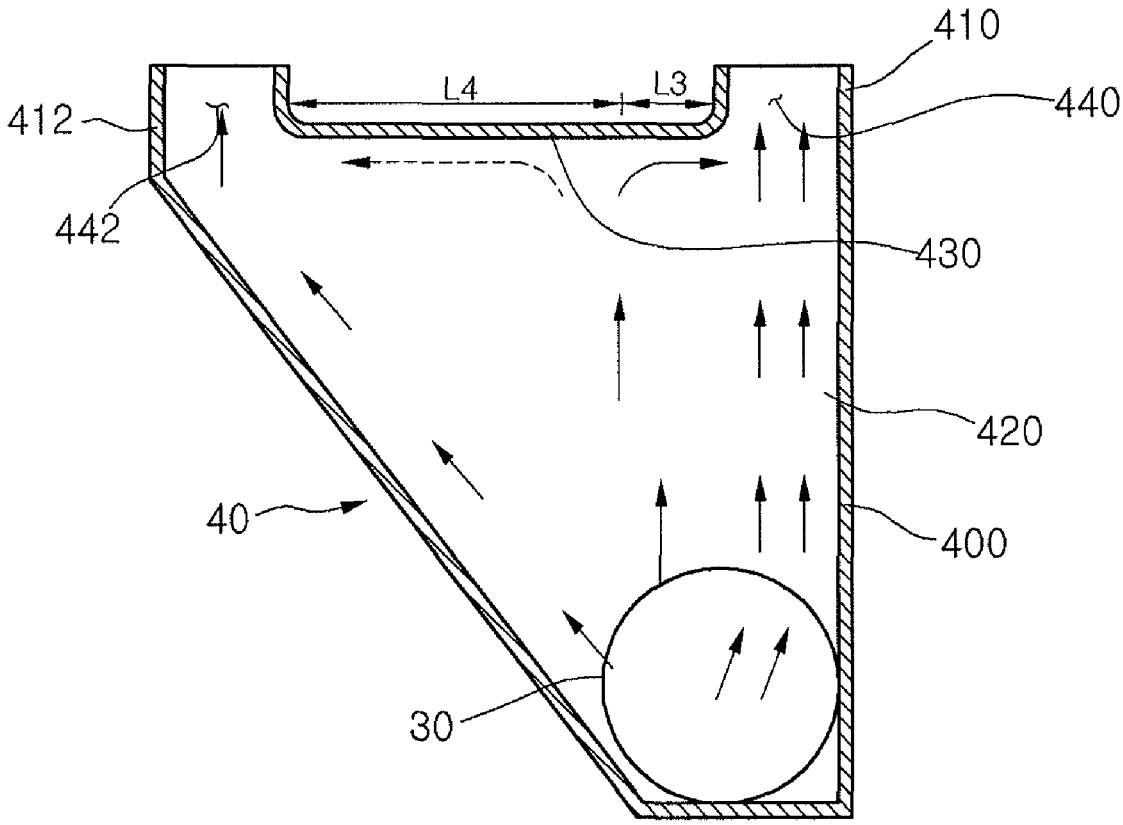
FIG. 6 is a cross-sectional view showing air flow in the distribution unit according to the second exemplary embodiment.

Referring to FIGS. 5 and 6, a distribution unit 40 according to a second exemplary embodiment of the present invention includes a body 400 that is laterally asymmetrically formed. The present exemplary embodiment is substantially the same as the first exemplary embodiment, except for the shape of the distribution unit. Accordingly, the characteristic parts of the present exemplary embodiment will be explained and the descriptions corresponding to the first exemplary embodiment will be omitted.

In particular, the distance L1 from a side adjacent to the suction guide 30 to a side adjacent to a first branch passage 440 of a first distributing pipe 410 is shorter than the distance L2 from a side adjacent to the suction guide 30 to a side adjacent to a second branch passage 442 of a second distributing pipe 412. That is, the body 400 is formed in a shape that is eccentric to the first distributing pipe 410. In addition, one side of the body 400 extends downwardly from the first distributing pipe 410 to the suction guide 30, and the other side of the body 400 is inclined from the second distributing pipe 412 to the suction guide 30. Accordingly, a main passage 420, through which air is flowed, is increased in its width toward the second distributing pipe 412. In this exemplary embodiment, the suction guide 30 is disposed adjacent to the first distributing pipe 410.

Having described the features of the second exemplary embodiment, the air flow in the distribution unit 40 will be explained. The air sucked from the outside is introduced into the main passage 420 via the suction guide 30. Unlike in the first exemplary embodiment, the air introduced into the main passage 420 is not uniformly distributed into the respective distributing pipe 410, 412, rather a large amount of air is unevenly distributed to the first distributing pipe 410 and a relatively small amount of air is distributed to the second distributing pipe 412. That is, because the distance L1 from the first distributing pipe 410 to a lower end of the body 400 is shorter than the distance L2 from the second distributing pipe 412 to the lower end of the body 400 as described above, large amount of air in the main passage 420 is moved to the first distributing pipe 410. Therefore, bulky dusts or other materials, such as a tissue, in the main passage 420 are moved to the first distributing pipe 410, and small and fine dusts are moved to the second distributing pipe 412.

Further, the large amount of air that reaches the distribution guide 430 along the main passage 420 is also distributed to the first distributing pipe 410. This occurs because the main passage 420 is eccentric to the first distributing pipe 410 and, as such, a distance L3 from a location where the air is distributed by the distribution guide 430 to the first distributing pipe 410 is shorter than a distance L4 from the location to the second distributing pipe 412. That is, because the configuration of the distribution unit 40 is eccentric to the first distributing pipe 410, bulky dusts are distributed to the first distributing pipe 410 and micro dusts are distributed to the second distributing pipe 412. Therefore, the air flow in the distribution unit 40 freely moves since the bulky dusts are not caught by the distribution guide 430.

Figure 7:
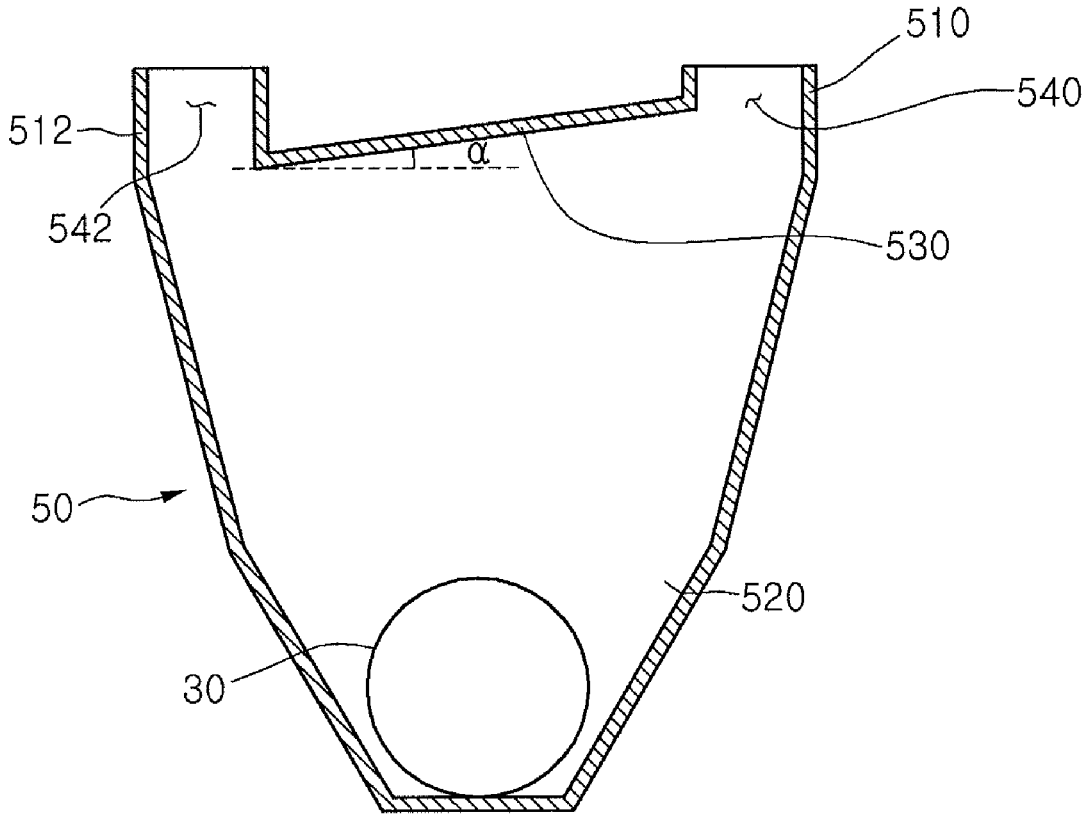
FIG. 7 is a cross-sectional view of a distribution unit according to a third exemplary embodiment.
Figure 8:
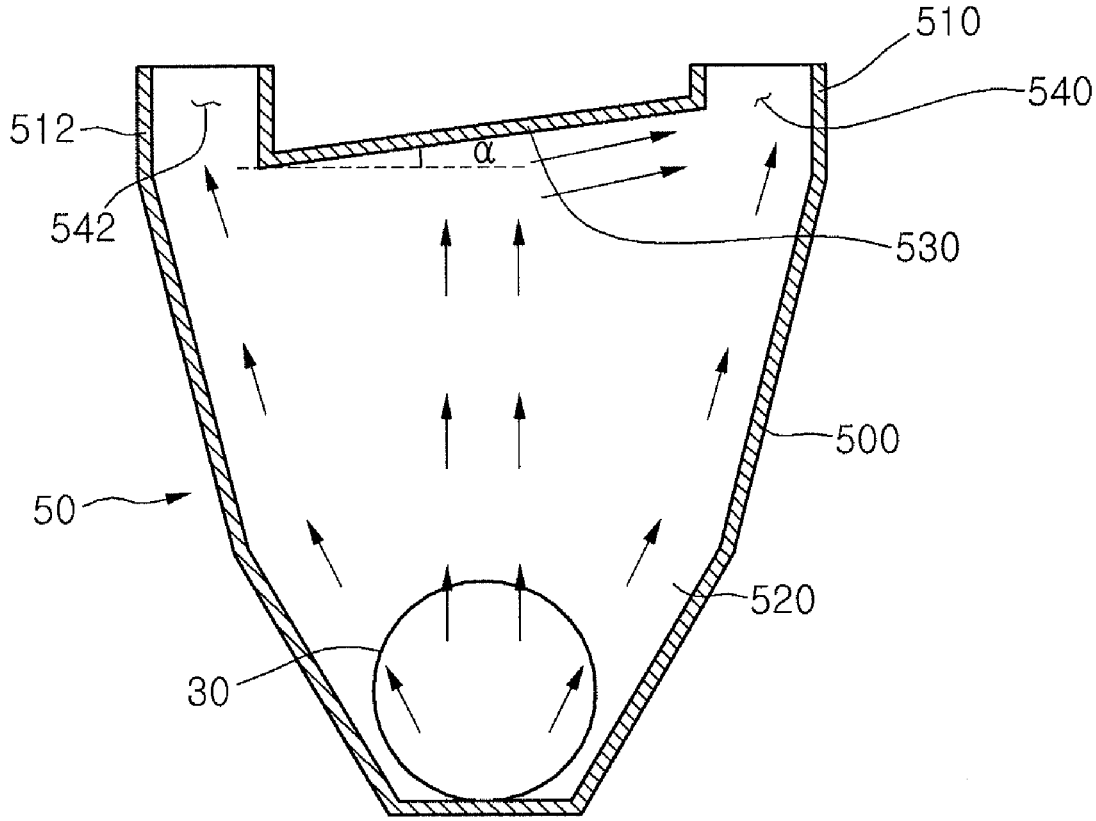
FIG. 8 is a cross-sectional view showing air flow in the distribution unit according to the third exemplary embodiment.

Referring to FIGS. 7 and 8, a distribution unit 50 according to a third exemplary embodiment of the present invention is provided. The present exemplary embodiment is similar to the first exemplary embodiment, except for the shape of the distribution unit 50. Accordingly, the characteristic parts of the present exemplary embodiment will be explained and the descriptions corresponding to the first exemplary embodiment will be omitted.

The distribution unit 50 includes a body 500 having a main passage 520, first and second distributing pipes 510, 512 to which air in the main passage 520 is distributed, and a distribution guide 530 that is inclinedly formed to distribute the air in the main passage 520 to the respective first and second distributing pipes 510, 512. In particular, the body 500 is laterally symmetrically formed from the suction guide 30 only to an inlet of the second distributing pipe 512.

In addition, the distribution guide 530 is upwardly inclined from the second distributing pipe 512 to a first distributing pipe 510. Particularly, the distribution guide 530 is formed to be inclined at a predetermined angle $\alpha$ with respect to a horizontal line. Accordingly, large amount of air in the main passage 520 is distributed to the first distributing pipe 510 by the distribution guide 530. In this exemplary embodiment, the angle $\alpha$ is preferably more than 10 degrees in order to accomplish the eccentric distribution of air flow.

In distribution guide 530, the air sucked from the outside is introduced into the main passage 520 via the suction guide 30. Next, some of the air introduced into the main passage 520 is directly moved to the first and second distributing pipes 510, 512 and the remainder of air is moved toward the distribution guide 530. The air moved toward the distribution guide 530 is distributed to the first distributing pipe 510 by the distribution guide 530. Accordingly, bulky dusts are prevented from being caught by the distribution guide 530, since the bulky dusts are moved toward the first distributing pipe 510 by the distribution guide 530.

Figure 9:
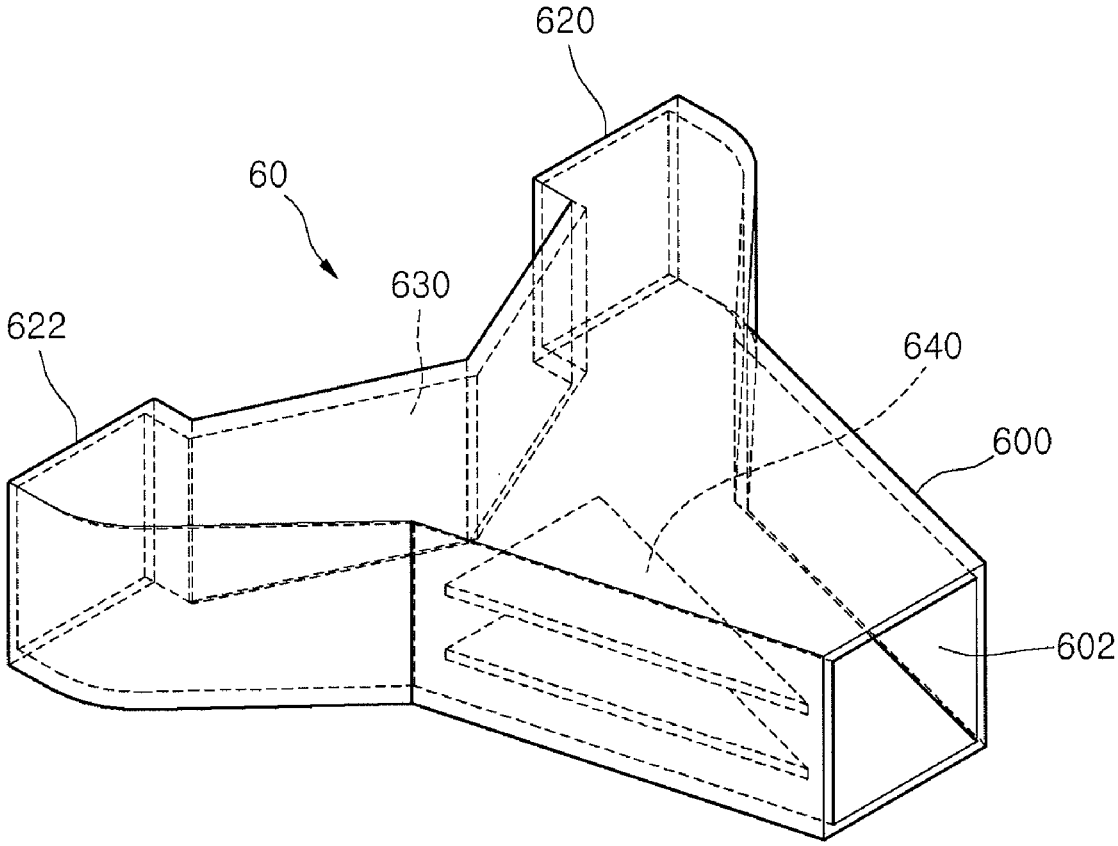
FIG. 9 is a perspective view of a distribution unit according to a fourth exemplary embodiment.
Figure 10:
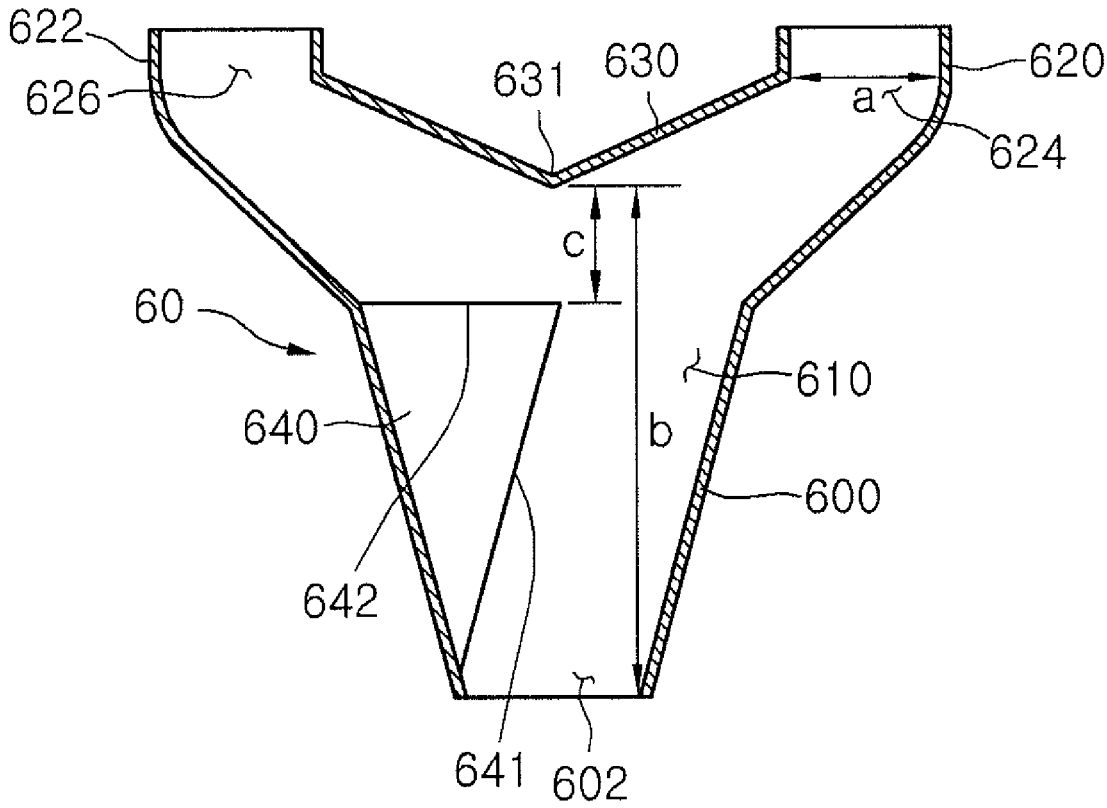
FIG. 10 is a cross-sectional view of the distribution unit according to the fourth exemplary embodiment.

Referring to FIGS. 9 and 10, a distribution unit 60 according to a fourth exemplary embodiment of the present invention is provided. The present exemplary embodiment is similar to the first exemplary embodiment, except for the shape of the distribution unit 60. Accordingly, the characteristic parts of the present exemplary embodiment will be explained and the descriptions corresponding to the first exemplary embodiment will be omitted.

The distribution unit 60 includes a body 600 having a main passage 610, a pair of distributing pipes 620, 622 that are extended from the body 600 and to which the air in the main passage 610 is distributed, and a guide element 640 that guides bulky dusts to any one of the distributing pipes 620, 622. In particular, a suction port 602 for sucking air is formed at the body 600. Further, a distribution guide 630, which distributes the air in the main passage 610 to the respective distributing pipe 620, 622, is formed at the body 600.

As best seen in FIG. 10, a boundary part 631, which is a boundary where the sucked air is distributed to the distributing pipes 620, 622, is formed at the center of the distribution guide 630. The body 600 is laterally symmetrically formed with respect to the boundary part 631. And the width of the body 600 increases from the suction port 602 to the respective distributing pipes 620, 622. That is, the passage cross-sectional area of the body 600 is increased from the suction port 602 to the respective distributing pipes 620, 622.

The guide element 640 is installed at only one side of the main passage 610. That is, the guide element 640 is disposed adjacent to the second distributing pipe 622 with respect to the boundary part 631. In this exemplary embodiment, a plurality of guide elements 640 is installed at intervals in a direction perpendicular to the air flow direction in the main passage 610. The arranged direction of the guide elements 640 is best seen in FIG. 9.

The distance between the guide elements 640 may be determined by considering the size of bulky dusts, such as a tissue. In this exemplary embodiment, the bulky dusts are moved toward a first branch passage 624 of the first distributing pipe 620, as the movement thereof is guided by a first end 641 of the guide element 640 while micro dusts are moved toward a second branch passage 626 of the second distributing pipe 622 by passing though a space between the guide elements 640. As a result, the air flow in the distribution unit 60 tends to be eccentric to the first distributing pipe 620, because of the installation of the guide element 640. This is because the guide element 640 serves as a resistance to the air flow. However, if the length of the main passage 610 is long enough, the air flow may substantially uniformly distributed.

As shown in FIG. 10, if it is assumed that the width of the respective distributing pipe 620, 622 is "a" and the distance from the boundary part 631 to the inlet port 602 is "b", "b"

will be at least twice as long as "a". Also, a second end 642 of the guide element 640 is spaced part from the boundary part 631 at a predetermined distance "c". In this exemplary embodiment, the predetermined distance "c" is preferably greater than 3 mm so that dusts such as a hair or a thread cannot be caught by the boundary part 631 or the guide element 640.

Figure 11:
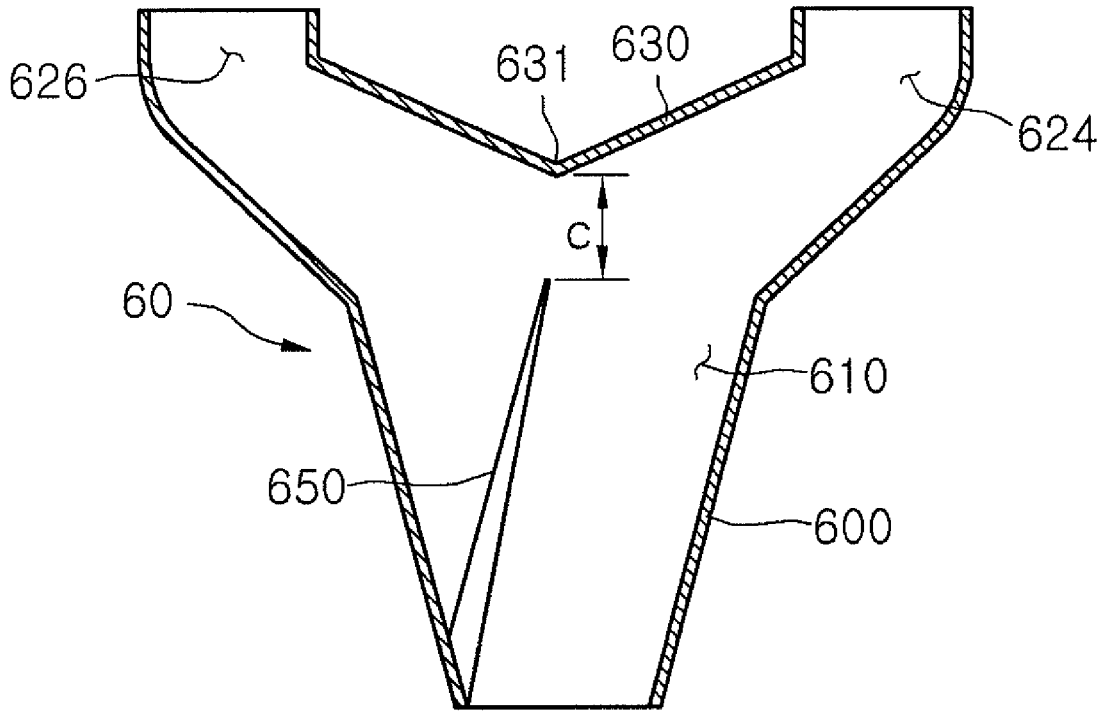
FIG. 11 is a cross-sectional view of a distribution unit according to a fifth exemplary embodiment.

Referring to FIG. 11, a distribution unit 60' according to a fifth exemplary embodiment is provided. The present exemplary embodiment is the same as the fourth exemplary embodiment, except for the shape of the guide element 650. Accordingly, the characteristic parts of the present exemplary embodiment will be explained and the descriptions corresponding to the fourth exemplary embodiment will be omitted.

Referring to FIG. 11, a circular cone shaped guide element 650 is provided in the distribution unit 60' of the present exemplary embodiment. The guide element 650 is installed at only one side of the main passage 610. That is, the guide element 650 is disposed adjacent to the second distributing pipe 622 with respect to the boundary part 631. Also, the guide element 650 is extended from one side of the body 600 toward the boundary part 631. An end of the guide element 650 is spaced apart from the boundary part 631 by a distance of "c." In addition, a plurality of guide elements 650 (not shown) may be installed at intervals in a direction perpendicular to the air flow direction in the main passage 620.

According to this distribution unit 60', as described in the fourth exemplary embodiment, bulky dusts such as a tissue are guided by the guide element 650 and are moved to the toward the first branch passage 624 while micro dusts are moved toward a second branch passage 626 by passing though a space between the guide elements 650.

Figure 12:
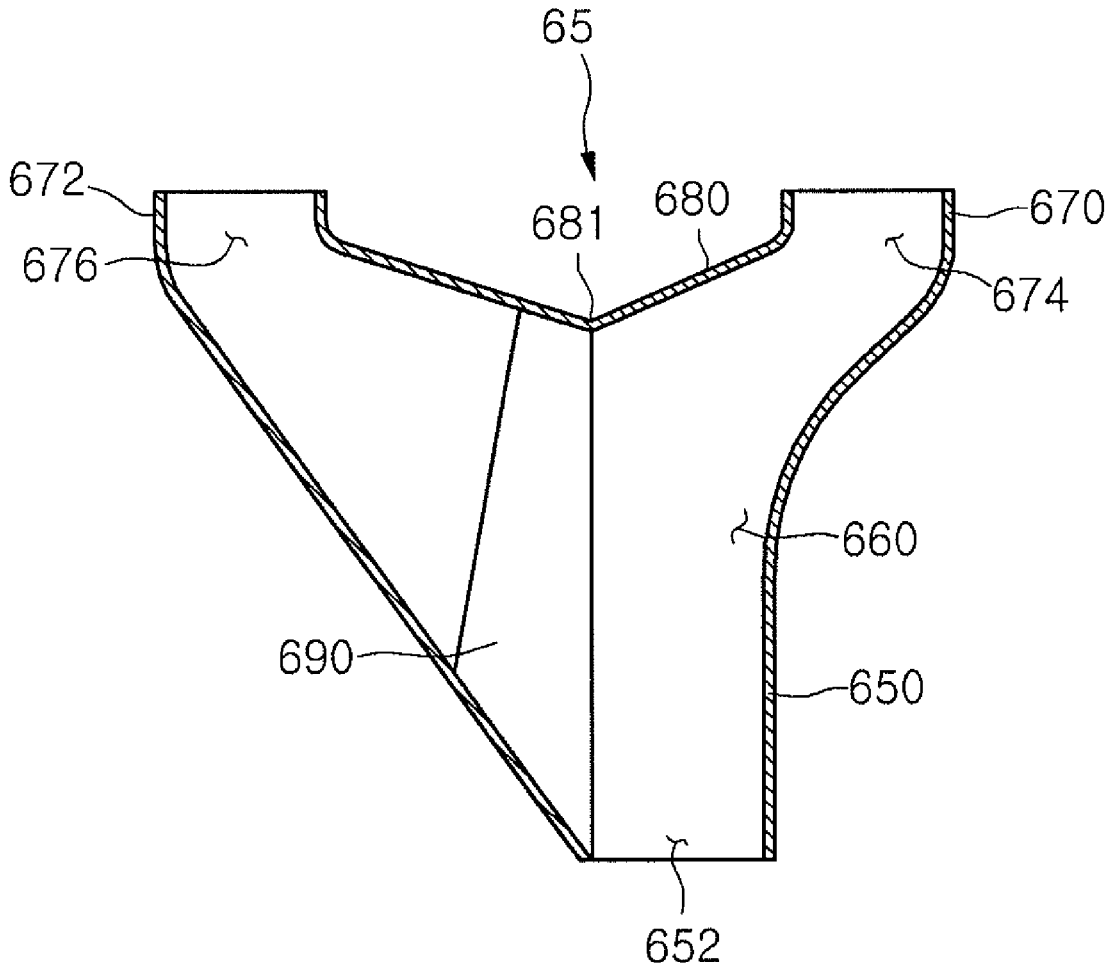
FIG. 12 is a cross-sectional view of a distribution unit according to a sixth exemplary embodiment.

Referring to FIG. 12, a distribution unit 65 according to a sixth exemplary embodiment of the present invention is provided. The present exemplary embodiment is similar to the first exemplary embodiment, except for the shape of the distribution unit 65. Accordingly, the characteristic parts of the present exemplary embodiment will be explained and the descriptions corresponding to the first exemplary embodiment will be omitted.

The distribution unit 65 according to the present exemplary embodiment includes a body 650 having a laterally asymmetric shape. In particular, the body 650 includes a suction port 652 from which air is sucked, a main passage 660 through which the sucked air is flowed, first and second distributing pipes 670, 672 where the air in the main passage 660 is distributed, and a distribution guide 680 that is disposed between the first and second distributing pipes 670, 672 to guide the air flow. Branch passages 674, 676 are formed at the corresponding first and second distributing pipes 670, 672, respectively.

A guide element 690 is formed at the main passage 620 and guides bulky dusts to be moved to one of the first or second distributing pipes 670, 672. The guide element 690 is formed to be adjacent to the second distributing pipe 672 with respect to a boundary part 681 of the distribution guide 680. The guide element 690 is connected to the distribution guide 680. Accordingly, the bulky dusts are moved toward the first distributing pipe 670 by the guide element 690.

Figure 13:
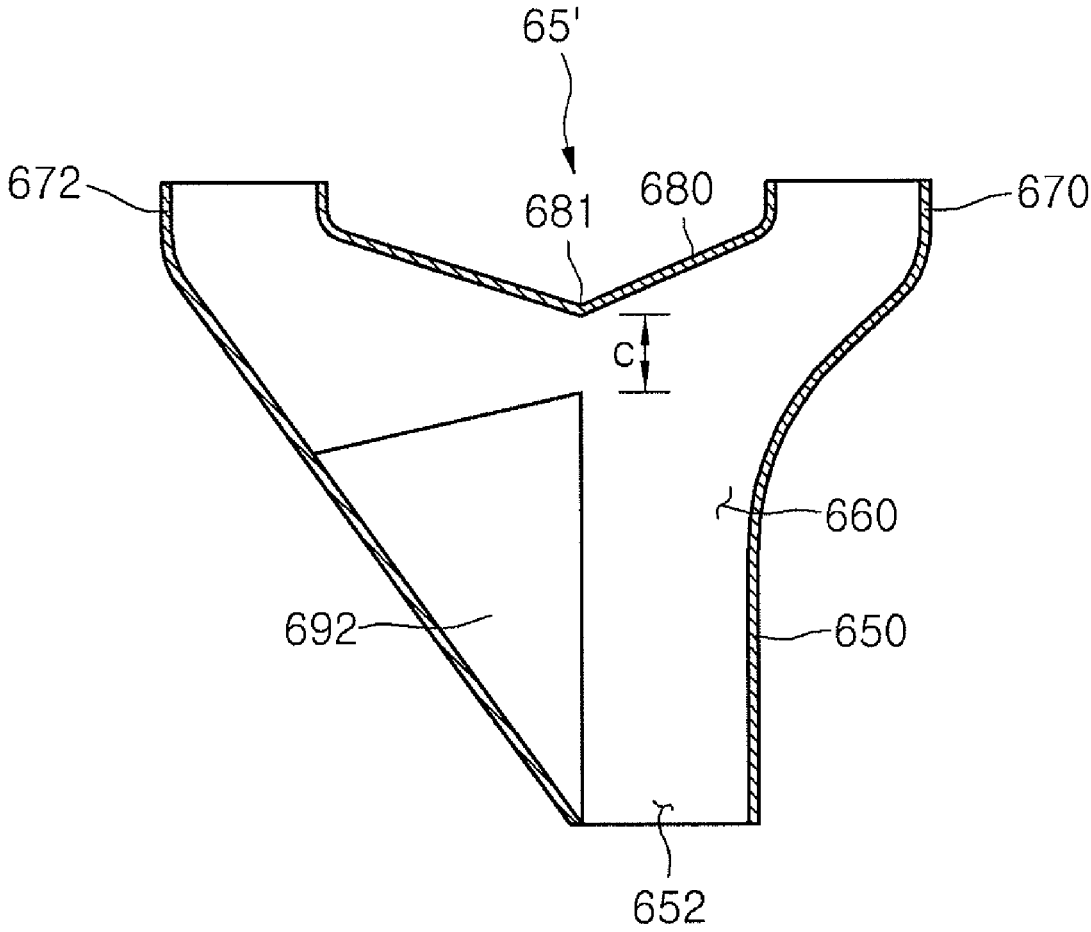
FIG. 13 is a cross-sectional view of a distribution unit according to a seventh exemplary embodiment.

Referring to FIG. 13, a distribution unit 65' according to a seventh exemplary embodiment is provided. The present exemplary embodiment is the same as the sixth exemplary embodiment, except for the shape of the guide element 692. Accordingly, the characteristic parts of the present exemplary embodiment will be explained and the descriptions corresponding to the sixth exemplary embodiment will be omitted.

The guide element 692 according to the present exemplary embodiment is formed to be adjacent to the second distributing pipe 672 with respect to the boundary part 681 of the distribution guide 680. An end of the guide element 692 is spaced apart from the boundary part 681 by a predetermined distance "c", and the distance "c" is preferably greater than 3 mm so that dusts such as a hair or a thread cannot be caught by the boundary part 681 or an end of the guide element 692.

Figure 14:
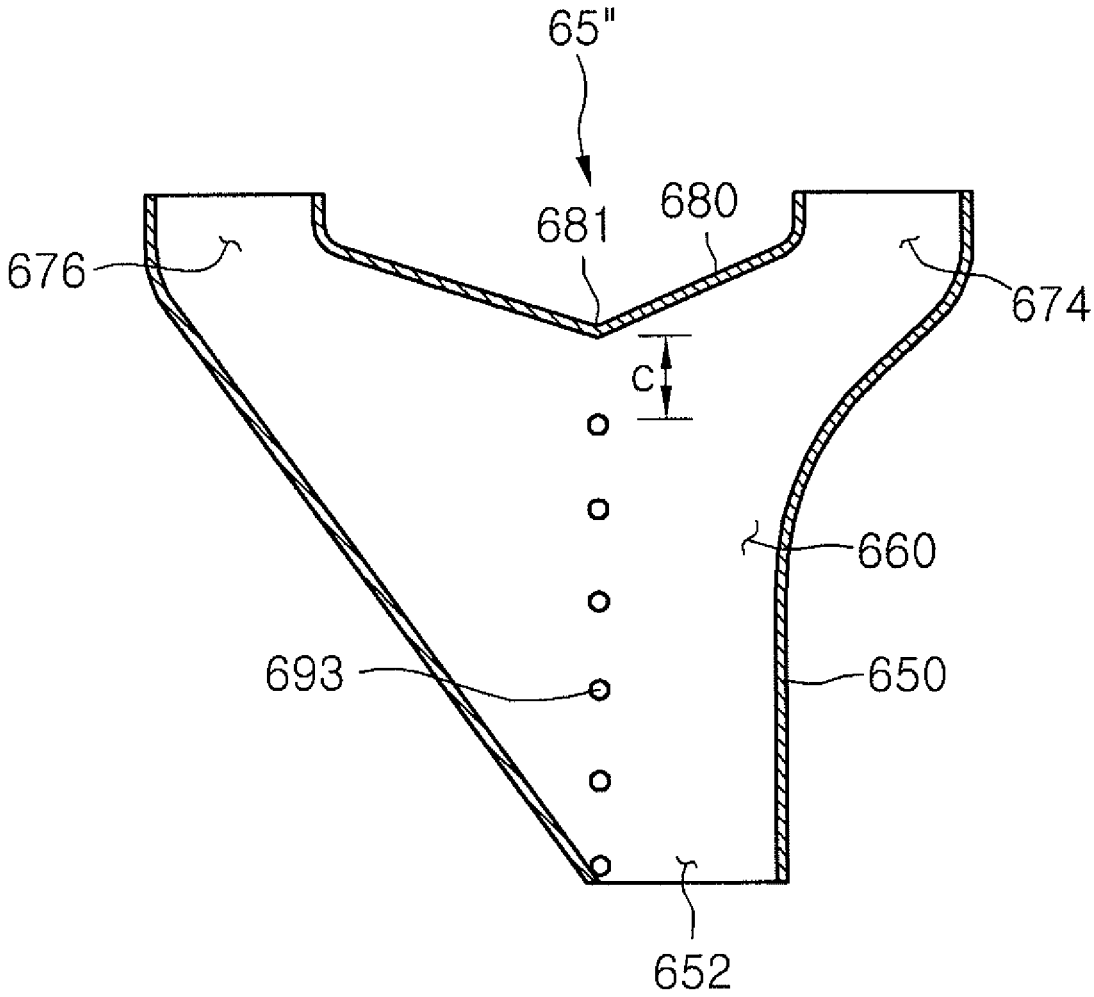
FIG. 14 is a cross-sectional view of a distribution unit according to a eighth exemplary embodiment.

Referring to FIG. 14, a distribution unit 65" according to an eighth exemplary embodiment is provided. The present exemplary embodiment is the same as the sixth exemplary embodiment, except for the shape and construction of the guide elements 693. Accordingly, the characteristic parts of the present exemplary embodiment will be explained and the descriptions corresponding to the sixth exemplary embodiment will be omitted.

A plurality of guide elements 693 are provided in the distribution unit 65" and the guide elements 693 are arranged from the boundary part 681 of the distribution guide 680 to the suction part 652 and are spaced at a predetermined interval. In addition, the distance "c" from the guide element 693 adjacent to the boundary part 681 to the boundary part 681 is preferably greater than 3 mm so that dusts such as a hair or a thread cannot be caught by the boundary part 681 or an end of the guide element 693.

Figure 15:
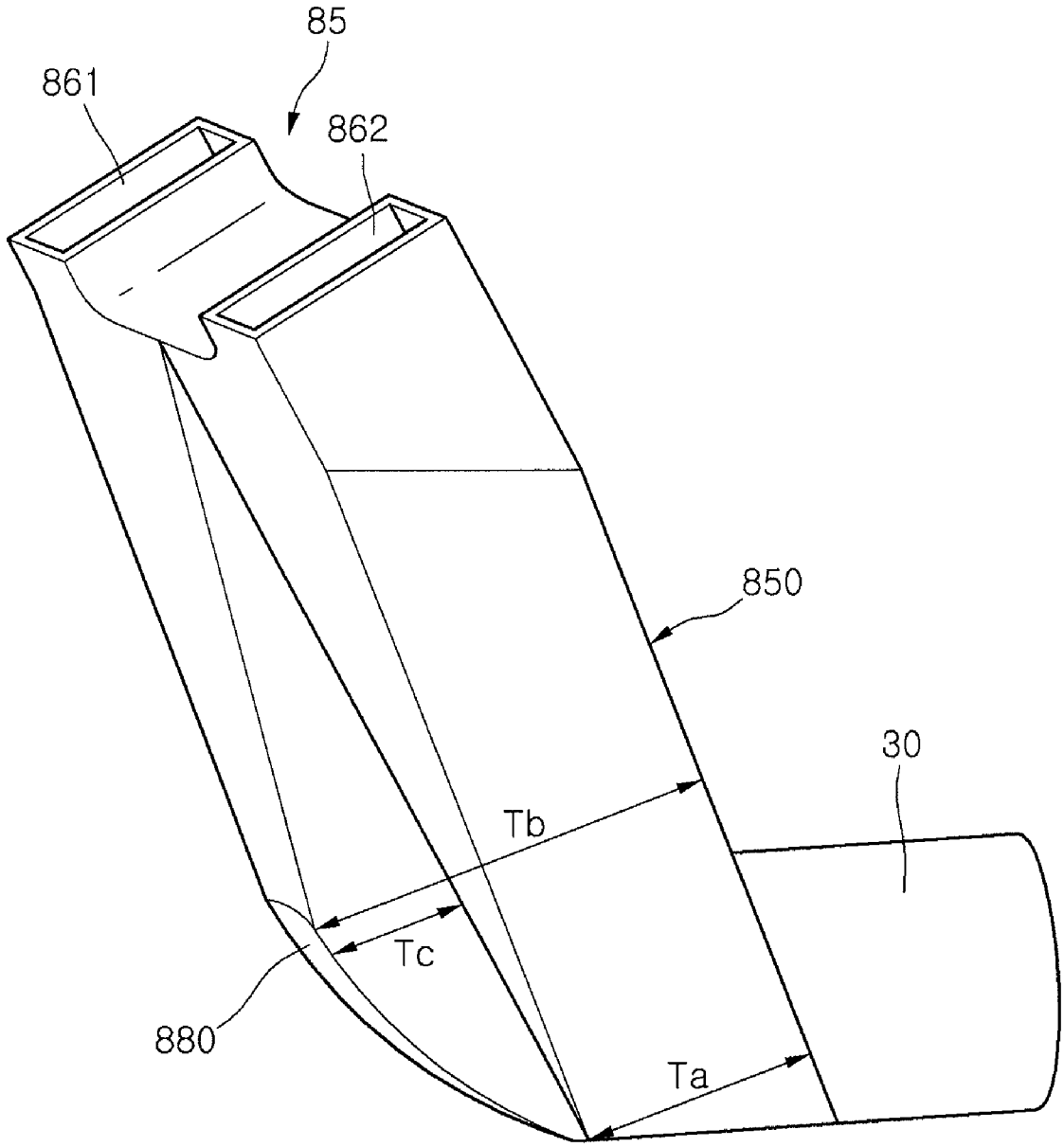
FIG. 15 is a perspective view of a distribution unit according to a ninth exemplary embodiment.
Figure 16:
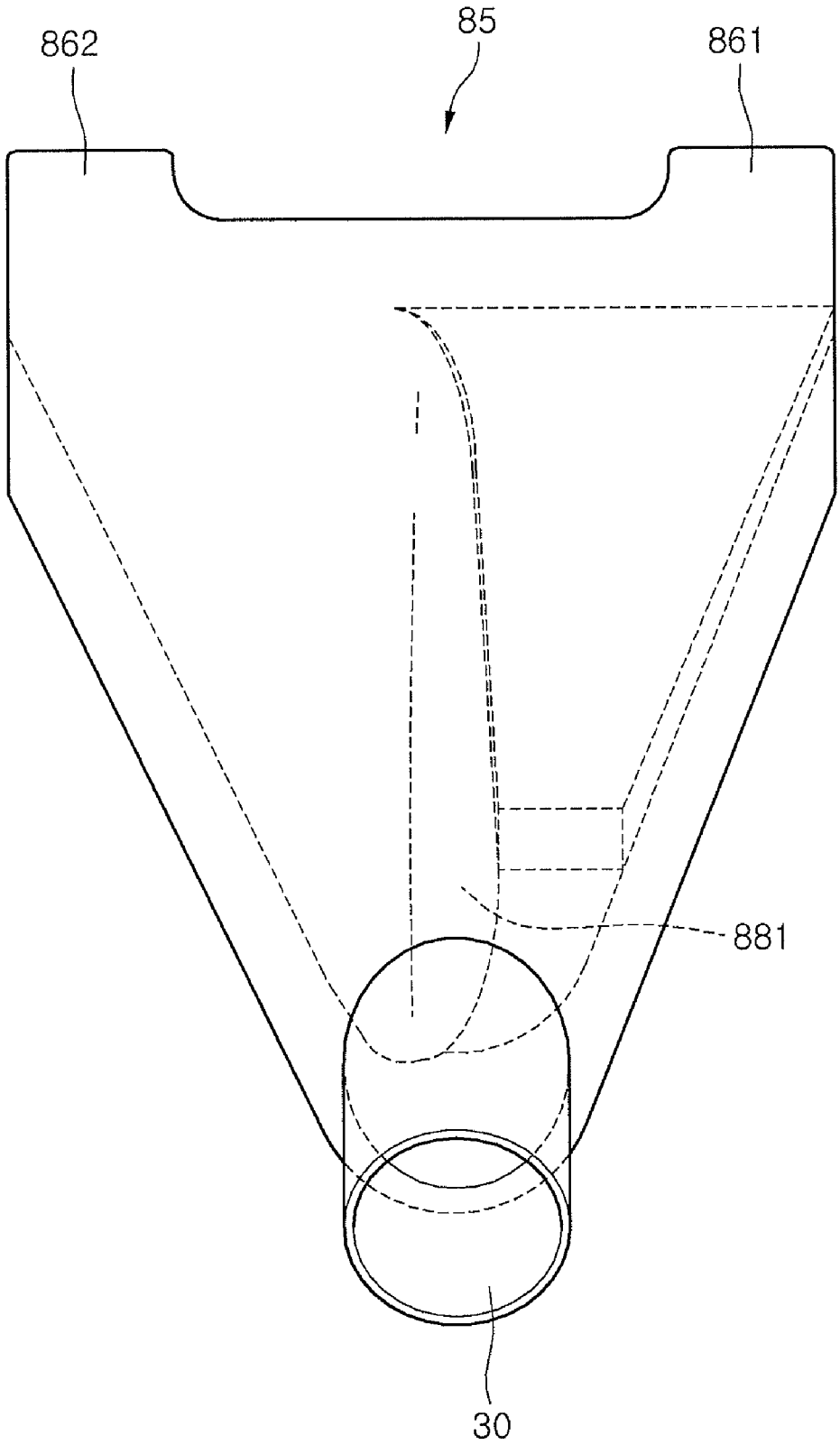
FIG. 16 is a front view of the distribution unit according to the ninth exemplary embodiment.
Figure 17:
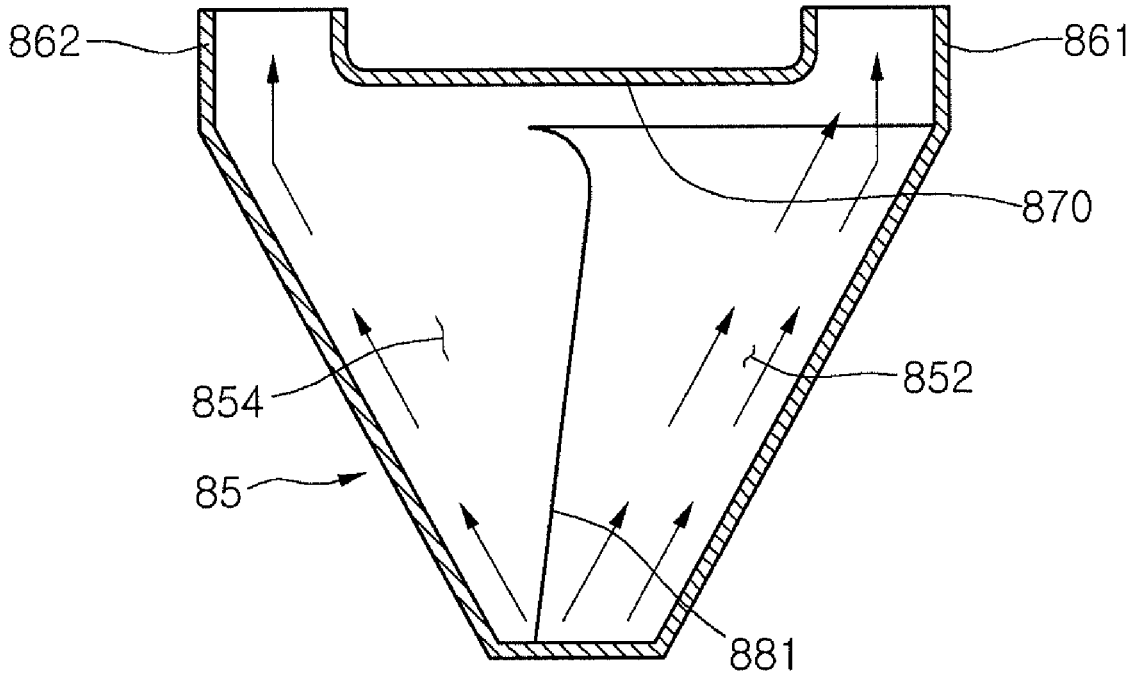
FIG. 17 is a cross-sectional view of the distribution unit according to the ninth exemplary embodiment.

Referring to FIGS. 15 to 17, a distribution unit 85 according to a ninth exemplary embodiment is provided. The present exemplary embodiment is similar to first exemplary embodiment, except for the shape of the distribution unit 85. Accordingly, the characteristic parts of the present exemplary embodiment will be explained and the descriptions corresponding to the first exemplary embodiment will be omitted.

The distribution unit 85 according to the present exemplary embodiment includes a body 850 that is formed to be laterally asymmetrically shaped. The body 850 includes a first distributing pipe 861 and a second distributing pipe 862 that distribute the air sucked into the body 850 to the dust separation unit 20, a first passage 852 and a second passage 854 that guide the air introduced from the suction guide 30 to the respective first and second distributing pipe 861, 862, and a distribution guide 870 that is formed between the distributing pipes 861, 862 in order to guide the air to be distributed to the respective distributing pipe 861, 862.

In addition, the body 850 includes a protrusion 880 that is provided such that some of the body 850 is outwardly protruded, and the first passage 852 is provided at a region where the protrusion 880 is formed. The second passage 854 is provided at the other side of the body 850 with respect to a guide 881 of the protrusion 880. The shape of the protrusion 880 is best seen in FIG. 15 and the discrimination between the first passage 852 and the second passage 854 is best seen in FIG. 17.

As a result of the configuration of the body 850, the volume of the first passage 852 is different from that of the second passage 854, because of the shape of the body 850. More specifically, the maximum thickness of the first passage 852 is equal to "Tb". In addition, the maximum thickness "Tb" of the first passage 852 is located between the first distributing pipe 861 and the suction guide 30 and the thickness of the first passage 852 decreases from the location of the maximum thickness "Tb" toward the first distributing pipe 861 and the suction guide 30. The thickness of the second passage 862 is constant and equal to "Ta". In other words, the cross-section area of the first passage 852 first increases from suction guide 30 to the location of maximum thickness "Tb" and then decreases again toward the first distributing pipe 861. Because of difference in thickness "Tc" between the maximum thickness "Tb" of the first passage and the maximum thickness "Ta" of the second passage 854, the volume of the first passage 852 is greater than that of the second passage 862.

In this exemplary embodiment, the bulky dusts introduced into the distribution unit via the suction guide 30 are moved toward the first passage 852, and therefore they are introduced into the first distributing pipe 861. Accordingly, the bulky dusts may be prevented from being caught in the distribution unit 85. Small dusts such as a micro dust are distributed to the first passage 852 and the second passage 854, respectively.

Figure 18:
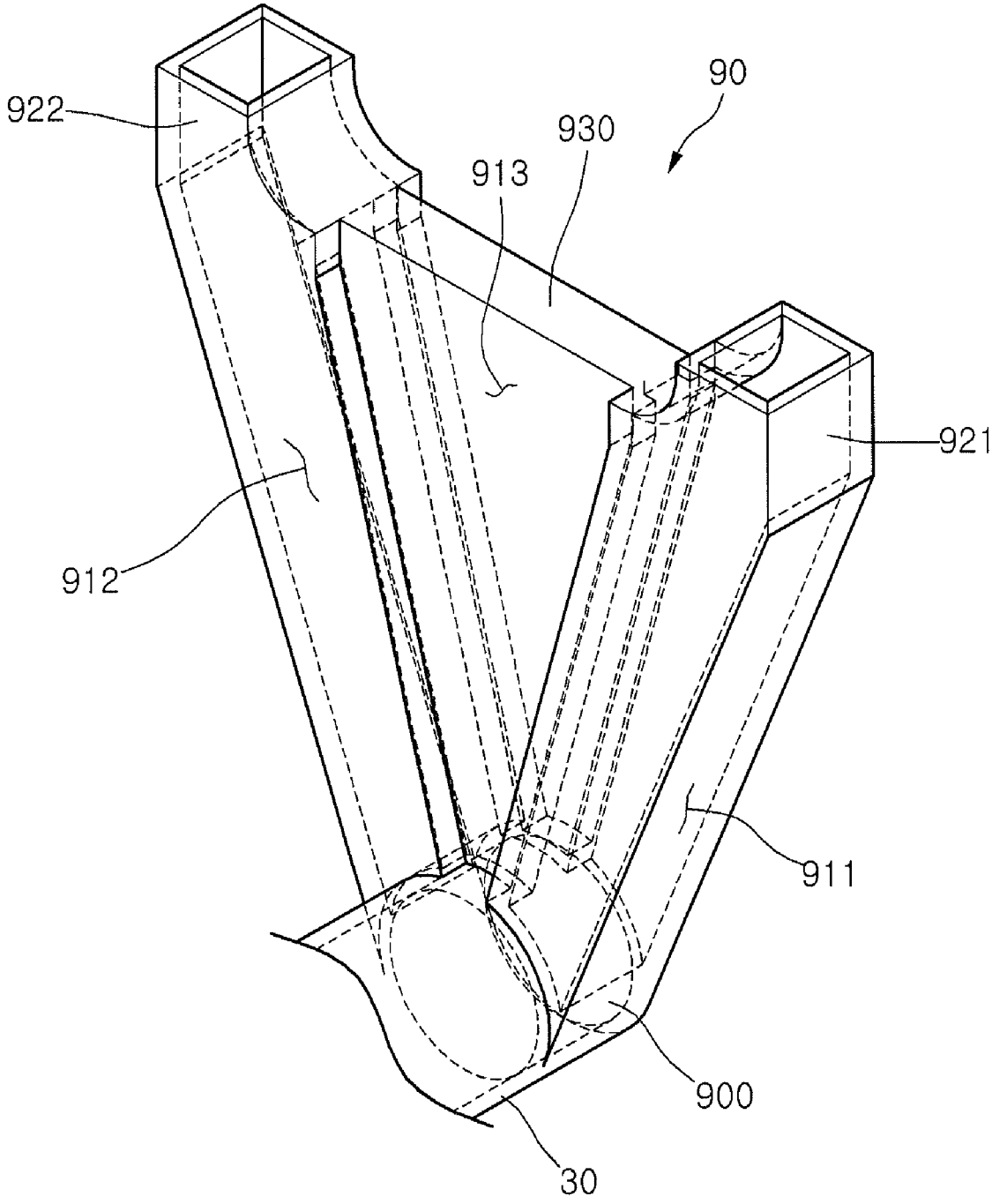
FIG. 18 is a perspective view of a distribution unit according to a tenth exemplary embodiment.
Figure 19:
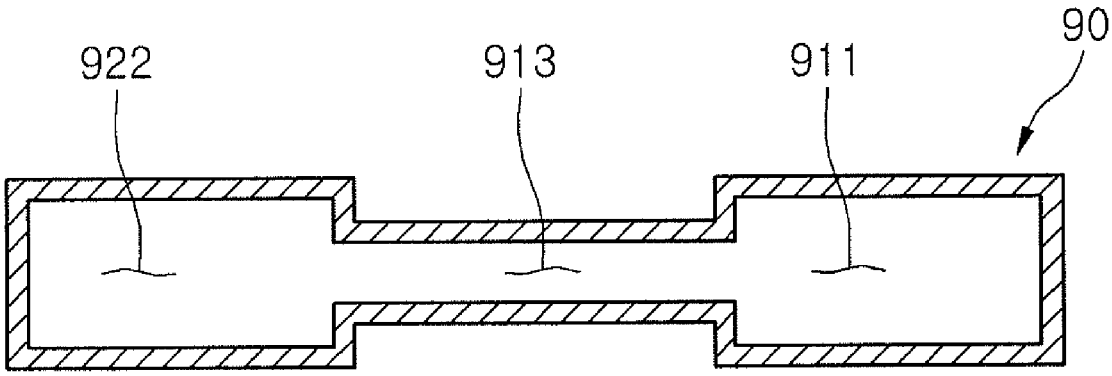
FIG. 19 is a horizontal cross-sectional view of the distribution unit.
Figure 20:
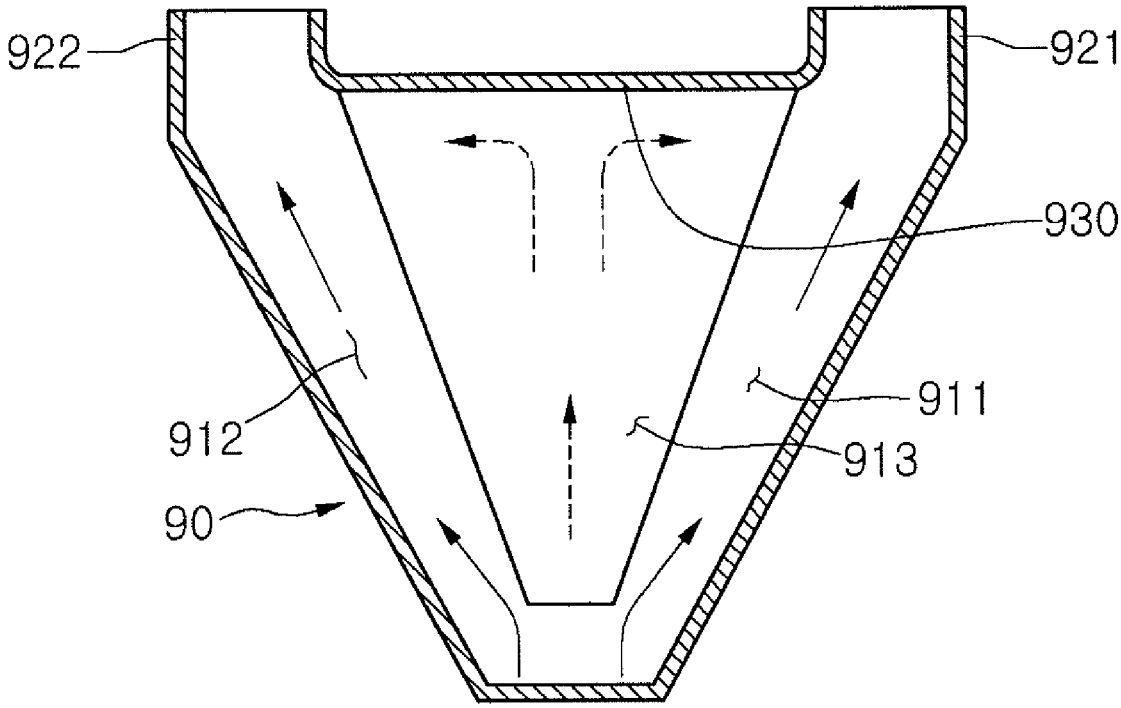
FIG. 20 is a vertical cross-sectional view of the distribution unit.

Referring to FIGS. 18 to 20, a distribution unit 90 according to a tenth exemplary embodiment is provided. The present exemplary embodiment is similar to the first exemplary embodiment, except for the shape and construction of the distribution unit. Accordingly, the characteristic parts of the present exemplary embodiment will be explained.

The distribution unit 90 according to the present exemplary embodiment includes a body 900 that is formed to be laterally symmetrically shaped. The body 900 includes a first branch passage 911, a second branch passage 912, and an intermediate passage 913 through which the air introduced into the body 900 flows. The body 900 also includes a first distributing pipe 921 and a second distributing pipe 922 which guide the air in the respective branch passages 911, 912 to the air-suction part (see reference numeral 210 in FIG. 1), and a distribution guide 930 that guides the air to the intermediate passage 913 and the respective distributing pipes 921, 922. The body 900 is formed to increase in width from a side adjacent to the suction guide 30 to a side adjacent to the respective distributing pipes 921, 922.

The intermediate passage 913 is formed between the first branch passage 911 and the second branch passage 912, and it is in communication with the respective first and second branch passages 911, 912. The passage cross-sectional area of the intermediate passage 913 increases increased as it is spaced apart from the suction guide 30 while the first branch passage 911 and the second branch passage 912 are formed to have the same passage cross-sectional area. And, as shown in FIGS. 18 and 19, a vertical width of the respective first and second branch passages 911, 912 is formed to be greater than a vertical width of the intermediate passage 913. That is, the thickness of the respective branch passage 911, 912 of the body 900 is formed to be greater than the thickness of the intermediate passage 913. Accordingly, in this exemplary embodiment, upper and lower surfaces of the body 900 are depressed to a predetermined depth in order to form the intermediate passage 913.

As a result of the configuration of the body 900, the air and micro dust, which are introduced into the body 900 via the suction guide 30, flow through the respective branch passage 911, 912 and the intermediate passage 913. However, any bulky dusts introduced into the body 900 are flowed through any one of the first and second branch passages 911, 912. That is, because the vertical width of the intermediate passage 913 is formed to be less than the vertical width of the first branch passage 911 and the second branch passage 912, the bulky dusts may be distributed to the first branch passage 911 or the second branch passage 912 without moving into the intermediate passage 913. In addition, when air and dust flowing through the intermediate passage 913 are moved toward the distribution guide 930, the air and the dust are redirected into the respective first and second branch passages 911, 912 as they are guided by the distribution guide 930.

Figure 21:
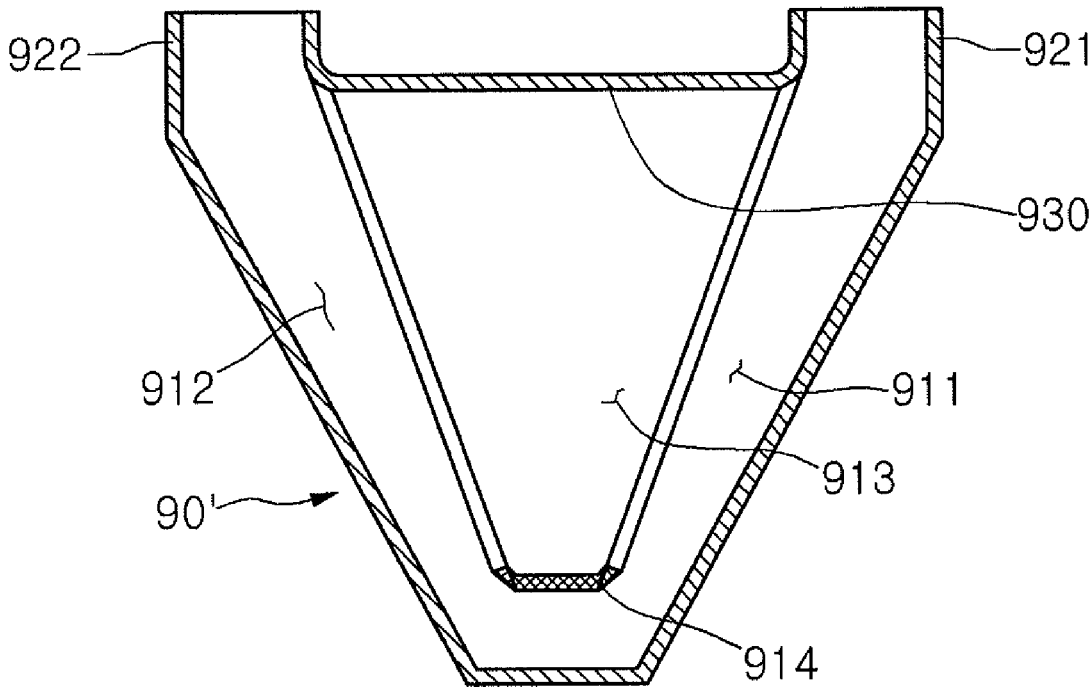
FIG. 21 is a cross-sectional view of a distribution unit according to an eleventh exemplary embodiment.

Referring to FIG. 21, a distribution unit 90' according to an eleventh exemplary embodiment is provided. The present exemplary embodiment is the same as the tenth exemplary embodiment, except for the inner construction of the distribution unit 90'. Accordingly, the characteristic parts of the present exemplary embodiment will be explained.

The distribution unit 90' includes a guide rib 914 is formed in the body 900 and is configured to guide bulky dusts of the introduced dusts to be distributed to the respective first and second branch passage 911, 912. The intermediate passage 913 is defined between the guide rib 914 and the distribution guide 930. The bulky dusts are preferably prevented from being caught in the distribution unit 90', because the dust sucked from the suction guide into the body 900 is introduced into the respective distributing pipe 921, 922 after the dust is distributed to the respective branch passage 911, 912 by the guide rib 914.

Figure 22:
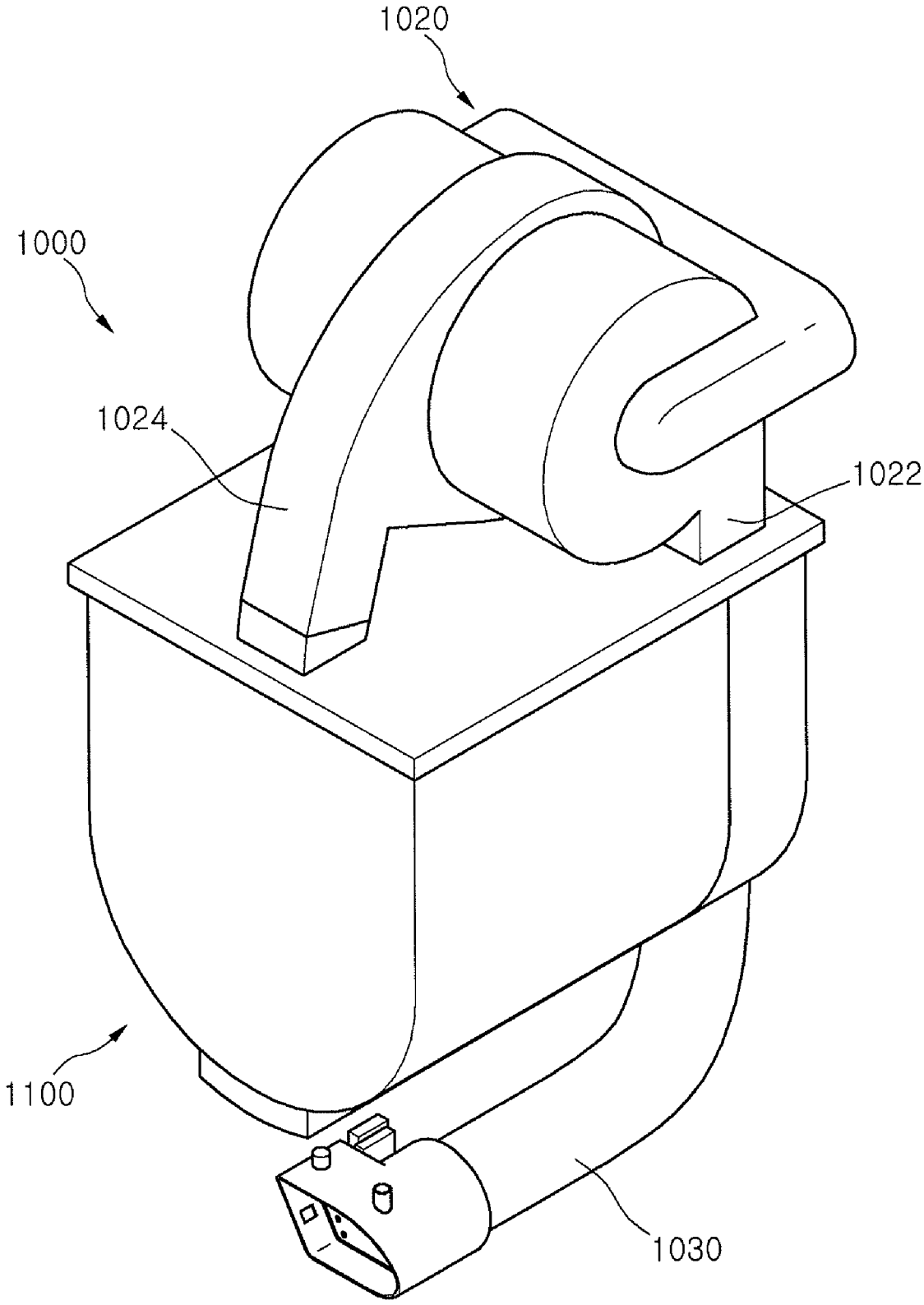
FIG. 22 is a perspective view of a dust separation apparatus according to a twelfth exemplary embodiment.

Referring to FIG. 22, a dust separation apparatus 1000 according to a twelfth exemplary embodiment includes a dust separation unit 1020 that separates dust from the sucked air, a dust collecting container 1100 in which the dust separated from the dust separation unit 1020 is collected, and a suction guide 1030 that guides the movement of the air containing dust to the dust collecting container 1100. The suction guide 1030 guides the air sucked from a suction nozzle (not shown) to the dust collecting container 1100 by first guiding the air to the dust separation unit 1020.

The dust separation unit 1020 includes a plurality of suction parts 1022 and a dust discharging part 1024. Because the dust separation unit 1020 according to the present exemplary embodiment is the same as that of the first exemplary embodiment, the detailed explanation thereof is omitted.

Figure 23:
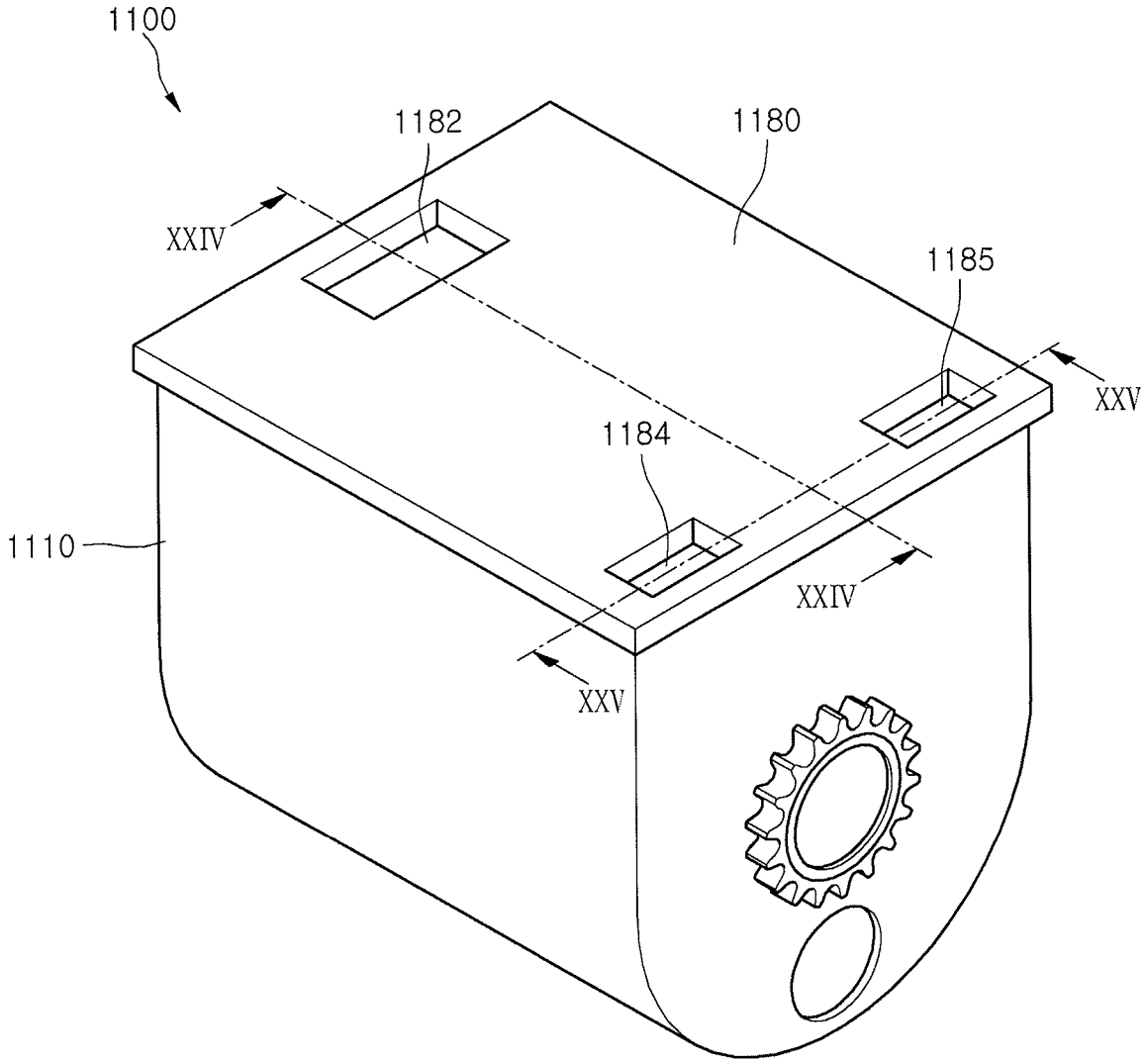
FIG. 23 is a perspective view of a dust collecting container of the dust separation apparatus of FIG. 22.
Figure 24:
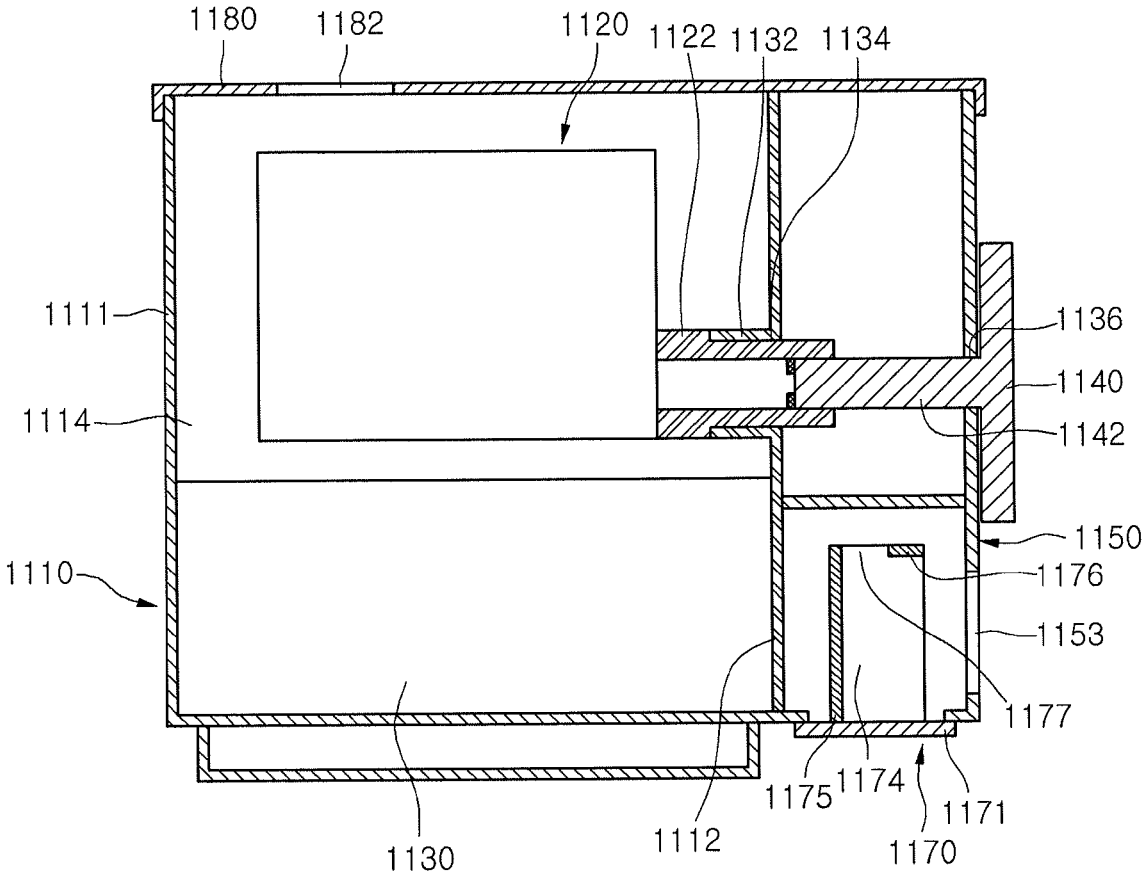
FIG. 24 is a cross-sectional view taken along line XXIV-XXIV in FIG. 23.
Figure 25:
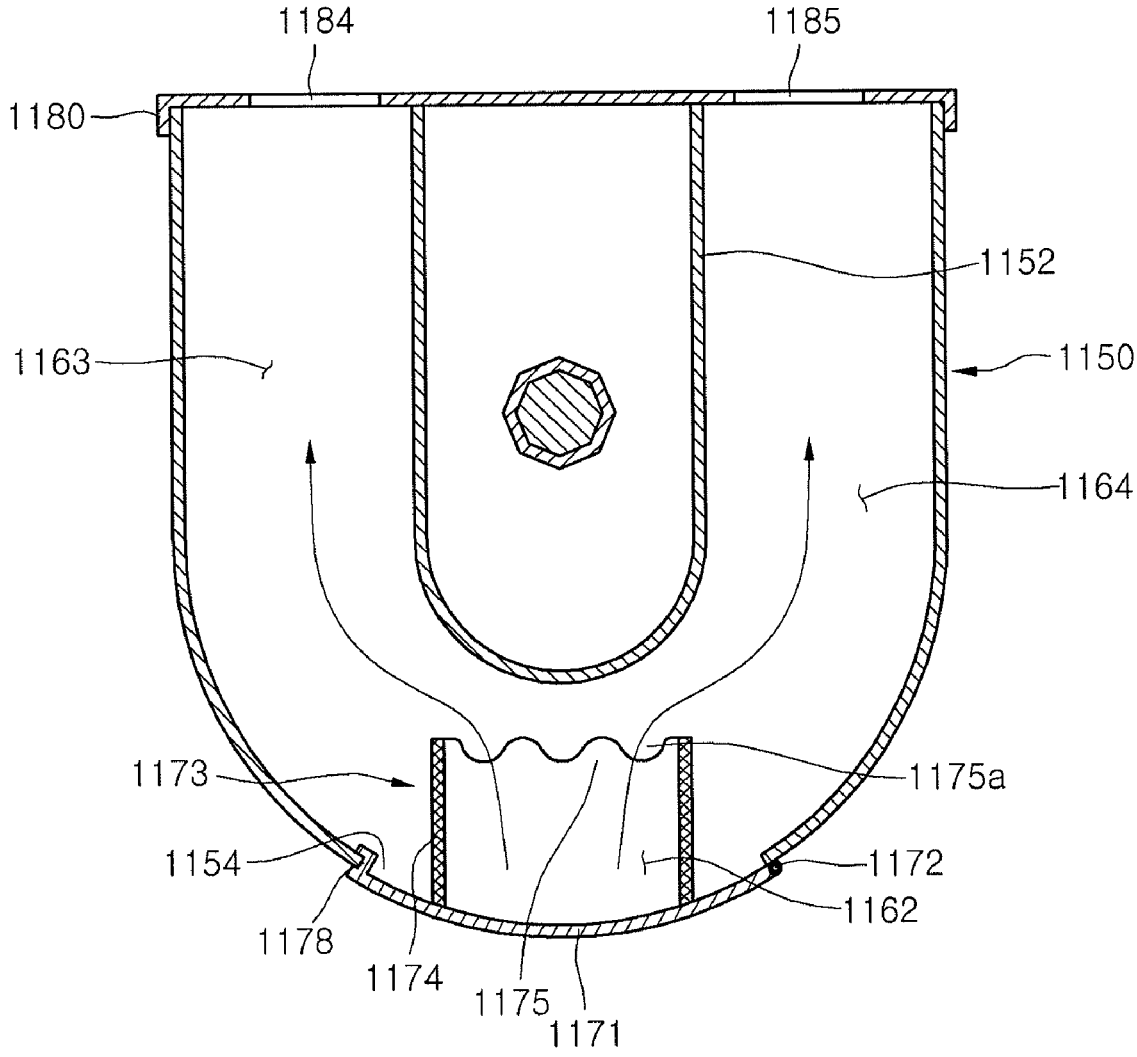
FIG. 25 is a cross-sectional view taken along line XXV-XXV in FIG. 23.

Referring to FIGS. 23 to 25, the dust collecting container 1100 according to the present exemplary embodiment includes a dust collecting body 1110, and a cover element 1180 that is connected to an upper part of the dust collecting body 1110. In particular, the dust collecting body 1110 includes a first wall 1111 forming an overall external appearance, and a second wall 1112 dividing an inner space of the first wall 1111 into two spaces.

A dust storage part 1114 for storing dust separated from the dust separation unit 1020 is formed at one side (left side as seen in FIG. 24) with respect to the second wall 1112, and a distribution unit 1150 for dividing the air introduced into the dust collecting body 1110 is formed at the other side (right side as seen in FIG. 24). That is, the distribution unit 1150 according to the present exemplary embodiment is integrally formed with the dust collecting container 1100.

In the dust storage part 1114, a pair of pressing elements for pressing the dust stored in the dust storage part 1114 is provided. Particularly, each pressing element includes a fixed element 1130 fixed on an inner circumferential surface of the dust storage part 1114 and a rotating element 1120 that is rotatably provided at the dust storage part 1114. The fixed element 1130 extends upwardly from a bottom surface of the dust storage part 1114 to a predetermined height. A through hole 1134, through which a rotating shaft 1122 of the rotating element 1120 is passed, is formed at the second wall 1112. A guide rib 1132 for guiding the rotation of the rotating shaft 1122 is protrudedly formed at the second wall 1112. And the rotating shaft 1122 is tightly connected to the guide rib 1132 when the rotating shaft 1122 passes through the through hole 1134.

Further, a portion of the rotating shaft 1122 is disposed in the distribution unit 1150 by passing through the through hole 1134 and is connected with a shaft 1142 of a driven gear 1140 perforating the first wall 1111 of the distribution unit 1150. That is, a through hole 1136 for passing the shaft 1142 of the driven gear 1140 is formed at the first wall 1111 of the distribution unit 1150. In this manner, power is transmitted from a drive gear (not shown), which is provided in the cleaner main body, to the driven gear 1140. The drive gear may be coupled with a compression motor provided at the cleaner main body. A portion of the drive gear may be exposed out of the cleaner main body. Therefore, the driven gear 1140 is mated with the drive gear when the dust collecting container 1100 is mounted on the cleaner main body.

The distribution unit 1150 also includes a main passage 1162 into which the air discharged from the suction guide 1030 is introduced, a pair of branch passages 1163, 1164 through which the air in the main passage 1162 is divided and flowed. While a pair of branch passages is formed, the number of the branch passage is not restricted thereto. Preferably, the number of branch passages is equal to the number of suction parts 1022 of the dust separation unit 1020. The distribution unit 1150 also includes an air inlet 1153 that allows air to be introduced into the main passage 1162. A partition 1152, by which the branch passages 1163, 1164 are divided, is formed at the distribution unit 1150, the partition 1152 guides the air in the main passage 1162 to be distributed to the respective branch passage 1163, 1164. As best seen in FIG. 25, the partition 1152 is formed in the shape of a letter "U," and is integrally formed with the second wall 1112.

According to this exemplary embodiment, an auxiliary separation unit 1170 is connected to the distribution unit 1150. The auxiliary separation unit separates bulky dusts such as a tissue from the air. Particularly, the auxiliary separation unit 1170 includes a dust separating part 1173 that separates bulky dusts such as a tissue from the air introduced into the main passage 1162. In this configuration, an opening 1154, through which the dust separating part can be pushed in the distribution unit 1150, is formed at the distribution unit 1150. Also, the auxiliary separation unit 1170 includes a cover 1171 that covers the opening 1154. One side of the cover 1171 is rotatably connected to the distribution unit 1150 by a hinge 1172, and the other side is detachably connected to the distribution unit 1150 by a fastening hook 1178.

The dust separating part 1173 is drawn out of the distribution unit 1150 when the opening 1154 is opened by rotating the cover 1171, and the cover 1171 is disposed at the main passage 1162 when closing the opening 1154. Therefore, according to the present exemplary embodiment, dusts caught by the dust separating part 1173 may be easily removed by drawing the dust separating part 1173 out of the distribution unit 1150. In addition, the inside of the distribution unit 1150 may be easily cleaned after the cover is rotated.

As best seen in FIG. 24, the dust separating part 1173 is spaced apart from the first and second walls 1111, 1112 while it is disposed in the main passage 1162. The dust separating part 1173 includes a pair of guides 1174 spaced apart at a specific interval, a connecting part 1175 that connects an end of the guide 1174 and is disposed adjacent to the second wall 1112, and a locking element 1176 that connects upper parts of the pair of the guide 1174. The horizontal width of the locking element 1176 is formed to be smaller than the horizontal width of the guide 1174 and the locking element 1176 is spaced apart from the connecting part 1175. Accordingly, a space 1177 is formed between the locking element 1176 and the connecting part 1175. Some of the air containing dust, which is introduced into the main passage 1162, passes through the space 1177, and the bulky dust such as a tissue is caught by the locking element 1176 while passing through the space 1177.

A plurality of through holes 1175*a*, through which air can be passed, are formed at an upper part of the connecting part 1175. Accordingly, the upper part of the connecting part 1175 is formed to have an uneven shape.

The cover element 1180 is connected to an upper part of the dust collecting body 1100 and is used to simultaneously close the dust storage part 1114 and the distribution unit 1150 in a state where the cover element 1180 is connected to the upper part of the dust collecting body 1100. A dust introducing hole 1182, which allows the air flowing along the dust discharging part 1024 to be introduced into the dust storage part 1114, is formed at the cover element 1180. Also, air discharging holes 1184, 1185, which allow the air in the respective branch passage 1163, 1164 to be discharged from the distribution unit 1150, are formed at the cover element 1180.

Having described the structure of the dust separation apparatus 1000, the operation of the dust separation apparatus will be explained. When the vacuum pressure is generated from the cleaner body, the air containing dust is moved along the suction guide 1030. Then the air flowing along the suction guide 1030 is introduced into the main passage 1162 of the distribution unit 1150 via the air inlet 1153 where the air containing dust is divided and introduced into the respective branch passage 1163, 1164. While the air containing dust in the main passage 1162 is divided into the respective branch passage 1163, 1164, the bulky dust such as a tissue is caught by the locking element 1176. Next, the air introduced into the respective branch passage 1163, 1164 is moved to the suction part 1022 of the dust separation unit 1020 via the air discharging holes 1184, 1185. In this manner, the air introduced into the dust separation unit 1020 contains the micro dust such as a hair. The dust separated from the dust separation unit 1020 is introduced into the dust storage part 1114 of the dust collecting container 1100 via the dust discharging part 1024 and the dust introducing hole 1182. According to the present exemplary embodiment, there is an advantage in that the bulky dust is not introduced into the dust separation unit 1020, as the bulky dust such as a tissue is caught in the dust separating part 1173 provided at the distribution unit 1150.

Figure 26:
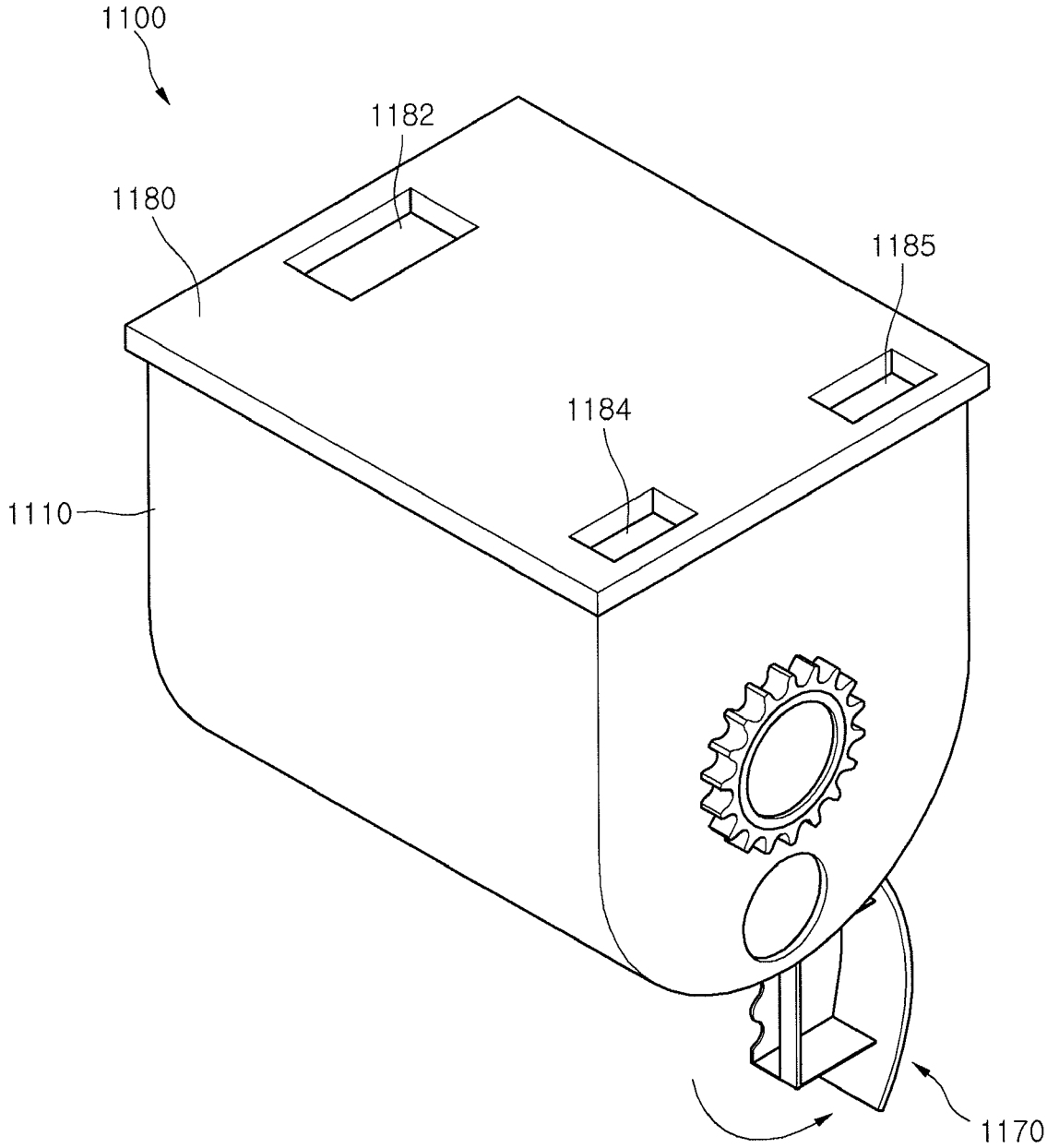
FIG. 26 is a perspective view showing an aspect that an auxiliary separation unit is drawn out of a dust collecting container according to the twelfth exemplary embodiment.

Referring to FIG. 26, the auxiliary separation unit 1170 is pulled from the lower side in order to remove dust caught in the lacking element 1176. Then, the auxiliary separation unit is rotated around the hinge 1172, and therefore the dust separating part 1173 where the locking element 1176 is formed is drawn out of the distribution unit 1150. The bulky dust such as a tissue is drawn together with the dust separating part 1173 while being caught by the locking element 1176. Therefore, a user may easily remove the tissue and so forth from the dust separating part 1173 drawn out of the distribution unit 1150.

The invention thus being described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A distribution unit to direct air and dust to a dust separation unit of a vacuum cleaner, the distribution unit comprising:

a body having an inlet configured to introduce the air and dust to the body, a plurality of branch passages for dividing the air and dust introduced into the body, and a main passage portion connecting the inlet to each of the branch passages, wherein a cross-sectional area of the main passage portion at the plurality of branch passages is greater than a cross-sectional area of the inlet, wherein the plurality of branching passages are arranged in parallel, and wherein the plurality of branch passages include a first branch passage and a second branch passage, and a distance between the inlet and one of the first and second branch passages is greater than a distance between the inlet and the other of the first and second branch passages.

2. The distribution unit of claim 1, wherein a cross-sectional area of the first branch passage at the main passage portion is greater than the cross-sectional area of the inlet.

3. The distribution unit of claim 1, wherein the main passage portion is configured such that the cross-sectional area of the main passage portion increases between the inlet and the plurality of branch passages.

4. The distribution unit of claim 1, wherein the main passage portion includes at least one guide element located therein to direct a portion of the air and dust introduced into the main passage portion toward one branch passage of the plurality of branch passages.

5. The distribution unit of claim 4, wherein the at least one guide element is a plurality of guide elements, the plurality of guide elements being spaced apart in a direction perpendicular to a flow direction of the air from the inlet to the plurality of branch passages.

6. The distribution unit of claim 1, wherein the body further includes a distribution guide that separates the first and second branch passages.

7. The distribution unit of claim 6, wherein the distribution guide is extended at an angle other than perpendicular to a flow direction of the air from the inlet to the first and second branch passages.

8. The distribution unit of claim 6, wherein the distribution guide extends slantedly from the first branch passage to the second branch passage.

9. The distribution unit of claim 1, wherein the body is formed to have a laterally asymmetric shape.

10. A dust separation apparatus of a vacuum cleaner, the dust separation apparatus comprising:

a dust separation unit having a plurality of air suction parts; and a distribution unit configured to direct air and dust to the plurality of air suction parts of the dust separation unit, the distribution unit including:

a body having an inlet configured to introduce the air and dust to the body, a plurality of branch passages for dividing the air and dust introduced into the body, and a main passage portion connecting the inlet to each of the branch passages, wherein a cross-sectional area of the main passage portion at the plurality of branch passages is greater than a cross-sectional area of the inlet, wherein the main passage portion includes at least one guide element located therein to direct a portion of air and dust introduced into the main passage portion toward one branch passage of the plurality of branch passages, and wherein the at least one guide element is disposed adjacent to one of the plurality of branch passages.

11. The dust separation apparatus of claim 10, wherein the plurality of branch passages includes a first branch passage, and a cross-sectional area of the first branch passage at the main passage portion is greater than the cross-sectional area of the inlet.

12. The dust separation apparatus of claim 10, wherein the main passage portion is configured such that the cross-sectional area of the main passage portion increases between the inlet and the plurality of branch passages.

13. The dust separation apparatus of claim 10, wherein the plurality of branch passages includes a first branch passage and a second branch passage, and a distance between the inlet and one of the first and second branch passages is greater than a distance between the inlet and the other of the first and second branch passages.

14. A distribution unit to direct air and dust to a dust separation unit of a vacuum cleaner, the distribution unit comprising:

a body having an inlet configured to introduce the air and dust to the body, a first passage having a first portion in communication with the inlet and a first outlet spaced from the inlet, a second passage having a second portion in communication with the inlet and a second outlet spaced from the inlet, a first distribution pipe in communication with the first passage, a second distribution pipe in communication with the second passage, and the first and second discharge pipes discharge air and dust to the dust separation unit, wherein a volume of the first passage is greater than a volume of the second passage, and wherein the body includes a protrusion portion that is provided such that some of the body is outwardly protruded, and the first passage is provided at a region where the protrusion is formed.

15. The distribution unit of claim 14, wherein a distance between the inlet and one of the first and second outlets is greater than a distance between the inlet and the other of the first and second outlets.

16. The distribution unit of claim 14, wherein the body is formed to have a laterally asymmetric shape.

17. The distribution unit of claim 14, wherein the first passage includes at least a region between the first portion in communication with the inlet and the first outlet where a cross-sectional area of the region first increases and then decreases from the first portion in communication with the inlet toward the first outlet.

18. A vacuum cleaner comprising:

a dust separation apparatus, the dust separation apparatus including:

a dust separation unit having a plurality of air suction parts; and a distribution unit configured to direct air and dust to the plurality of air suction parts of the dust separation unit, the distribution unit including:

a body having an inlet configured to introduce the air and dust to the body, a first passage having a first portion in communication with the inlet and a first outlet spaced from the inlet, and a second passage having a second portion in communication with the inlet and a second outlet spaced from the inlet, wherein a volume of the first passage is greater than a volume of the second passage; and a suction motor in communication with the dust separation unit, wherein the body includes a protrusion portion that is provided such that some of the body is outwardly protruded, and the first passage is provided at a region where the protrusion is formed.

19. The vacuum cleaner of claim 18, wherein a distance between the inlet and one of the first and second outlets is greater than a distance between the inlet and the other of the first and second outlets.

20. The vacuum cleaner of claim 18, wherein the body is formed to have a laterally asymmetric shape.

21. The vacuum cleaner of claim 18, wherein the first passage includes at least a region between the first portion in communication with the inlet and the first outlet where a cross-sectional area of the region first increases and then decreases from the first portion in communication with the inlet toward the first outlet.

22. A distribution unit to direct air and dust to a dust separation unit of a vacuum cleaner, the distribution unit comprising:

a body having an inlet configured to introduce the air and dust to the body, a first passage having a first portion in communication with the inlet and a first outlet spaced from the inlet, a second passage having a second portion in communication with the inlet and a second outlet spaced from the inlet, a first distribution pipe in communication with the first passage, a second distribution pipe in communication with the second passage, and the first and second discharge pipes discharge air and dust to the dust separation unit, wherein the body is formed to have a laterally asymmetric shape.

23. The distribution unit of claim 22, wherein a distance between the inlet and one of the first and second outlets is greater than a distance between the inlet and the other of the first and second outlets.

24. The distribution unit of claim 22, wherein the first passage includes at least a region between the first portion in communication with the inlet and the first outlet where a cross-sectional area of the region first increases and then decreases from the first portion in communication with the inlet toward the first outlet.

25. The distribution unit of claim 22, wherein the body includes an intermediate passage that is in communication with the first and second passages, the intermediate passage being configured to receive at least some of the air and dust, and a vertical width of each of the first and second passages with respect to an airflow direction is greater than a vertical width of the intermediate passage with respect to the airflow direction.

* * * * *